US009070241B2

(12) United States Patent
Fujita et al.

(10) Patent No.: US 9,070,241 B2
(45) Date of Patent: Jun. 30, 2015

(54) BILL STORAGE BOX AND BILL HANDLING DEVICE

(75) Inventors: Junji Fujita, Tokyo (JP); Minoru Kadowaki, Tokyo (JP); Naoaki Nishizawa, Tokyo (JP); Akihiro Nagura, Tokyo (JP)

(73) Assignee: Hitachi-Omron Terminal Solutions, Corporation, Tokyo (JP)

( * ) Notice: Subject to any disclaimer, the term of this patent is extended or adjusted under 35 U.S.C. 154(b) by 0 days.

(21) Appl. No.: 14/123,411

(22) PCT Filed: Jun. 3, 2011

(86) PCT No.: PCT/JP2011/003138

§ 371 (c)(1),
(2), (4) Date: Feb. 21, 2014

(87) PCT Pub. No.: WO2012/164629

PCT Pub. Date: Dec. 6, 2012

(65) Prior Publication Data

US 2014/0190787 A1 Jul. 10, 2014

(51) Int. Cl.

| | |
|---|---|
| ***G07D 11/00*** | (2006.01) |
| ***B65H 83/02*** | (2006.01) |
| ***B65H 1/14*** | (2006.01) |

(Continued)

(52) U.S. Cl.

CPC ..... *G07D 11/0012* (2013.01); *G07D 11/0039* (2013.01); *B65H 83/025* (2013.01); *B65H 1/14* (2013.01); *B65H 3/0669* (2013.01); *B65H 2403/42* (2013.01); *B65H 2405/332* (2013.01); *B65H 1/28* (2013.01); *B65H 3/5215* (2013.01); *B65H 2402/45* (2013.01); *B65H 2403/21* (2013.01); *B65H 2404/61* (2013.01);

(Continued)

(58) Field of Classification Search

CPC ..... G07D 11/00; G07D 11/0012; G07D 11/0096; G07D 2211/00; G07F 7/04

USPC ..... 194/206, 344, 350; 206/425, 449, 555, 206/558, 561; 232/1 D, 44; 902/9, 11–13

See application file for complete search history.

(56) References Cited

U.S. PATENT DOCUMENTS

| | | | | |
|---|---|---|---|---|
| 7,322,518 | B2 * | 1/2008 | Yokoi et al. | 235/379 |
| 2010/0218707 | A1 * | 9/2010 | Billet et al. | 109/53 |

(Continued)

FOREIGN PATENT DOCUMENTS

| | | |
|---|---|---|
| JP | 08-221636 | 8/1996 |
| JP | 2008-152430 A | 7/2008 |
| JP | 2011-145782 A | 7/2011 |

OTHER PUBLICATIONS

PCT International Search Report on application PCT/JP2011/003138 mailed Jul. 5, 2011; 1 page.

*Primary Examiner* — Mark Beauchaine
(74) *Attorney, Agent, or Firm* — Foley & Lardner LLP

(57) ABSTRACT

The present invention is characterized in that at least a first bill storage unit and a second bill storage unit are stacked and arranged in the stated sequence from a bill insert/discharge port side provided to the upper surface of the bill storage box; a door for loading and removing bills inside the bill storage units, and an opening and closing part for removing bills retained in an internal conveyance path between the first bill storage unit and the internal conveyance path are included; and the opening and closing direction of the door for loading and removing bills in the first bill storage unit and the opening and closing direction of the opening and closing part are substantially the same.

11 Claims, 23 Drawing Sheets

(51) Int. Cl.
*B65H 3/06* (2006.01)
*B65H 1/28* (2006.01)
*B65H 3/52* (2006.01)

(52) U.S. Cl.
CPC ..... *B65H2404/63* (2013.01); *B65H 2405/313* (2013.01); *B65H 2555/25* (2013.01); *B65H 2701/1912* (2013.01)

(56) References Cited

U.S. PATENT DOCUMENTS

| | | | | |
|---|---|---|---|---|
| 2011/0048890 | A1* | 3/2011 | Billet et al. | 194/206 |
| 2011/0074098 | A1 | 3/2011 | Ichikawa et al. | |
| 2011/0169210 | A1 | 7/2011 | Nagura et al. | |

* cited by examiner

BILL STORAGE BOX AND BILL HANDLING DEVICE

TECHNICAL FIELD

The present invention relates to such a bill handling device as to be mounted to an automated teller machine (ATM) which, for example, is installed in a financial institution or the like, and a bill storage box with which the bill handling device is loaded.

BACKGROUND ART

Heretofore, a bill handling device has been mounted to an automated teller machine which is used in a financial institution or the like. This bill handling device is provided with a bill insert/discharge port through which a user carries out charging and taking-out of bills, and a bill discriminating unit for discriminating inserted bills or bills to be paid. Also, the bill handling device is provided with a temporarily storage box for temporarily storing inserted bills until the transaction is done, a bill storage box for storing and charging bills, and a bill conveyance path for conveying bills to each of the units described above.

The bill storage box includes a reject box for storing reject bills which are discriminated as not reaching a predetermined reference in the bill discriminating unit, a recycle box for storing bills for insert as well as discharge by denomination, a loading box for carrying out supplement of the bills to the recycle box, and recovery of the bills from the recycle box, and the like.

In recent days, along with an increase in denomination transacted in the ATM, a bill handling device to which as many bill storage boxes as possible are mounted has been proposed. For example, in a bill handing device described in a PATENT LITERATURE 1, plural bill storage boxes are disposed in a lower portion of the device and in an anteroposterior direction of the device side by side, and other mechanical units such as a bill insert/discharge port, a bill discriminating unit, and a temporarily storage box are intensively disposed in the upper portion of the device.

The denominations which can be handled in the bill handing device correspond to the number of bill storage boxes described above. That is to say, many denominations can be handled as the number of bill storage boxes is larger. However, in the case of the bill handling device described in the PATENT LITERATURE 1, the bill handling device grows in size in an anteroposterior direction in correspondence to the number of bill storage boxes. For this reason, a bill handling device which can cope with the increase in denomination without causing the device to grow in size has been required.

For the request as described above, as shown in a PATENT LITERATURE 2, a bill storage box which includes plural storage units in the inside thereof is proposed. In the case of the bill storage box described in the PATENT LITERATURE 2, plural denominations can be handled by one bill storage box. For this reason, even when more bill storage box is not added, it becomes possible to provide the bill handling device which can cope with the increase in denomination.

CITATION LIST

Patent Literatures

PATENT LITERATURE 1: JP-A-H08-221636
PATENT LITERATURE 2: JP-A-2008-152430

SUMMARY OF INVENTION

Technical Problem

The bill storage box disclosed in the PATENT LITERATURE 2 includes a bill insert/discharge port through which bills are inserted and discharged from and to the outside, a sorting gate for switching connection of a conveyance path in order to sort conveyance destinations of the bills, and plural storage units having a feeding/accumulation mechanical unit (a feed roller, a gate roller, and the like) for carrying out a feeding operation and an accumulating operation for bills. The bill storage box concerned is provided with an internal conveyance path for conveying bills in a vertical direction of a storage box, and a sorting gate for sorting storage destinations of bill.

When the bills being conveyed are retained (jammed) due to some sort of cause in the bill storage box described above (especially, in the inside of the feeding/accumulation mechanical unit, on the internal conveyance path, and on the sorting gate), the retained bills (jammed bills) are removed away by opening a door provided in the bill storage box. However, the jammed bills are hard to remove away in some cases depending on an opening and closing direction of the door, and an opening and closing degree (an angle at which the opening and closing are carried out) of the door. For this reason, it is necessary to enhance the workability.

The present invention aims at providing a bill storage box in which jammed hills are easy to remove away, and a bill handling device which is loaded with the bill storage box.

Solution to Problem

In order to solve the problems described above, the present invention is characterized in that at least a first bill storage unit and a second bill storage unit are stacked and arranged in the stated sequence from a bill insert/discharge port side provided to the upper surface of the bill storage box; a door for loading and removing bills inside the bill storage units, and an opening and closing part for removing bills retained in an internal conveyance path between the first bill storage unit and the internal conveyance path are included; and the opening and closing direction of the door for loading and removing bills in the first bill storage unit and the opening and closing direction of the opening and closing part are substantially the same.

Advantageous Effects of Invention

According to the present invention, the jammed bills retained on the internal conveyance path is made easy to remove away to the outside of the bill storage box, whereby it is possible to provide the bill storage box in which the workability is enhanced, and it is possible to increase a satisfaction level of a user.

DESCRIPTION OF EMBODIMENTS

Embodiment 1

Hereinafter, a description will be given with respect to a first embodiment of the present invention with reference to the drawings.

Figure 1:
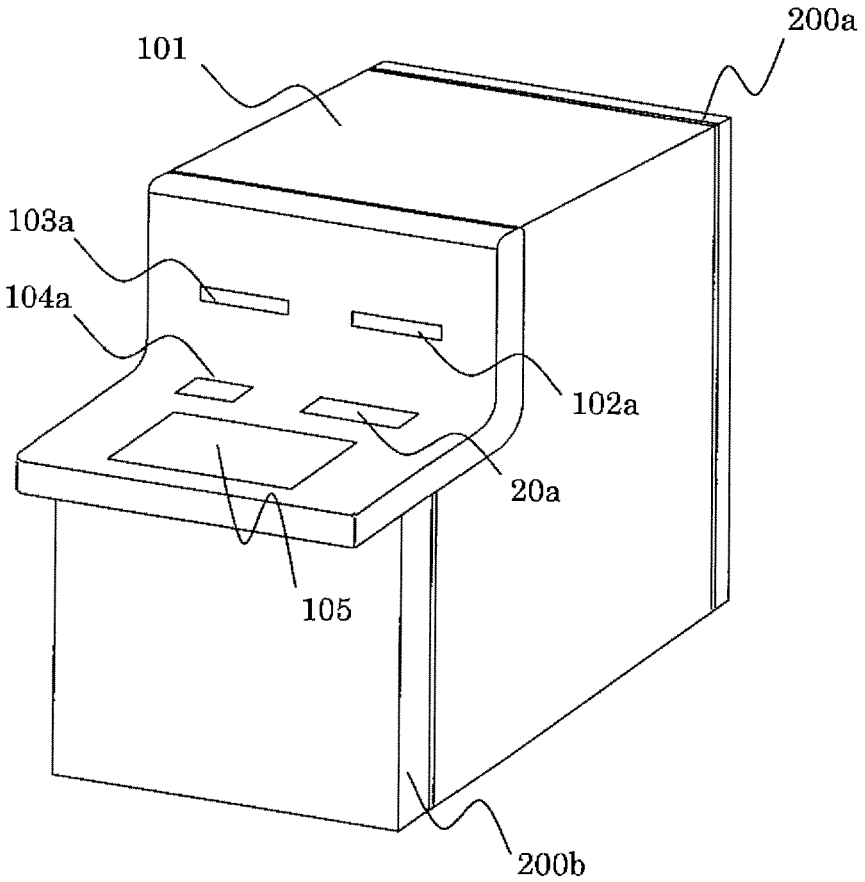
FIG. 1 An external appearance perspective view when an ATM is viewed from a front surface side thereof.
Figure 2:
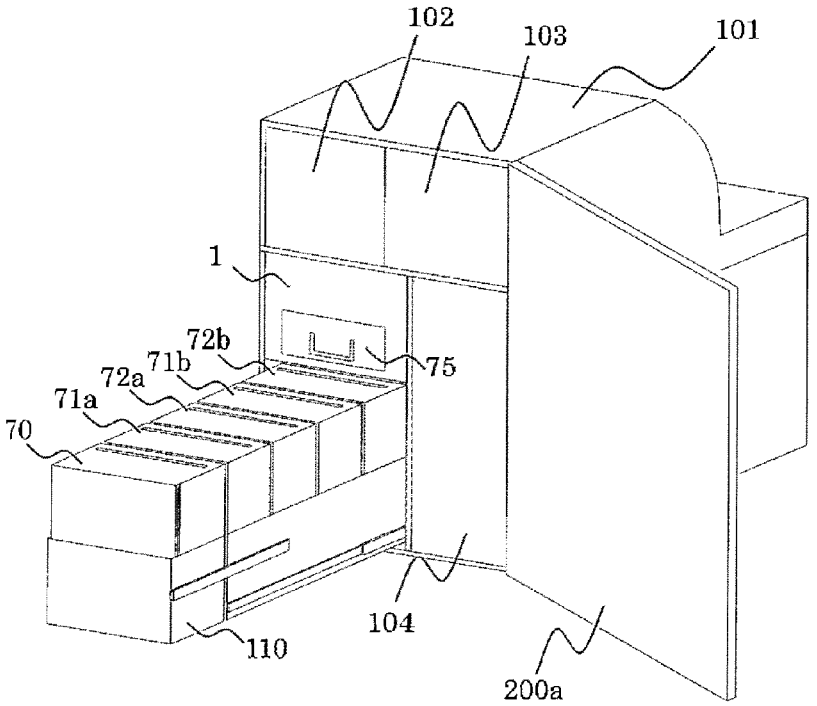
FIG. 2 An external appearance perspective view when an ATM is viewed from a back surface side thereof.

FIG. 1 and FIG. 2 are respectively external appearance perspective views when an ATM is viewed from a front surface side thereof and when the ATM is viewed from a back surface side thereof.

A card/statement processing unit 102 which communicates with a card slot 102*a*, and which processes a card of a user, and prints a transaction statement which is in turn discharged is provided inside an upper right-hand portion of an ATM 101. A passbook processing unit 103 which communicates with a passbook slot 103*a*, and which processes a passbook of the user, and prints a transaction detail which is in turn discharged is provided inside an upper left-hand portion of the ATM 101.

In addition, a bill handling device 1 for processing bills is provided inside a lower right-hand portion of the ATM 101. In the bill handling device 1, a bill insert/discharge port through which the user carries out the charging and taking-out of bills communicates with a shutter 20*a*. Thus, the bill handling device 1 processes credit transaction and disbursement transaction of the bills. A coil processing unit 104 for processing coins is provided inside a lower left-hand portion of the ATM 101. In the coil processing unit 104, the insert/discharge port communicates with the shutter 104*a*. Thus, the coil processing unit 104 processes the credit transaction and the disbursement transaction of the coins. It is noted that the ATM may have a configuration in which it does not includes the coil processing unit 104.

In addition, a front surface of the ATM. 101 is provided with a customer manipulating unit 105 for displaying and inputting the contents of the transaction.

The bill handling device 1 includes a tray 110 as an installation unit of the bill storage box in a lower portion thereof. Bill storage boxes 70, 71*a*, 71*b*, 72*a*, 72*b* are detachably mounted to a tray 110 in a state in which they are disposed in a line in an anteroposterior direction of the ATM 101 to the tray 110. It is noted that although in FIG. 2, a structure is adopted in which a door 200*a* of a back surface is opened to pull out a tray 111, a structure may also be adopted in which a door 200*b* shown in FIG. 1 of a front surface is opened to pull out the tray 111.

Figure 3:
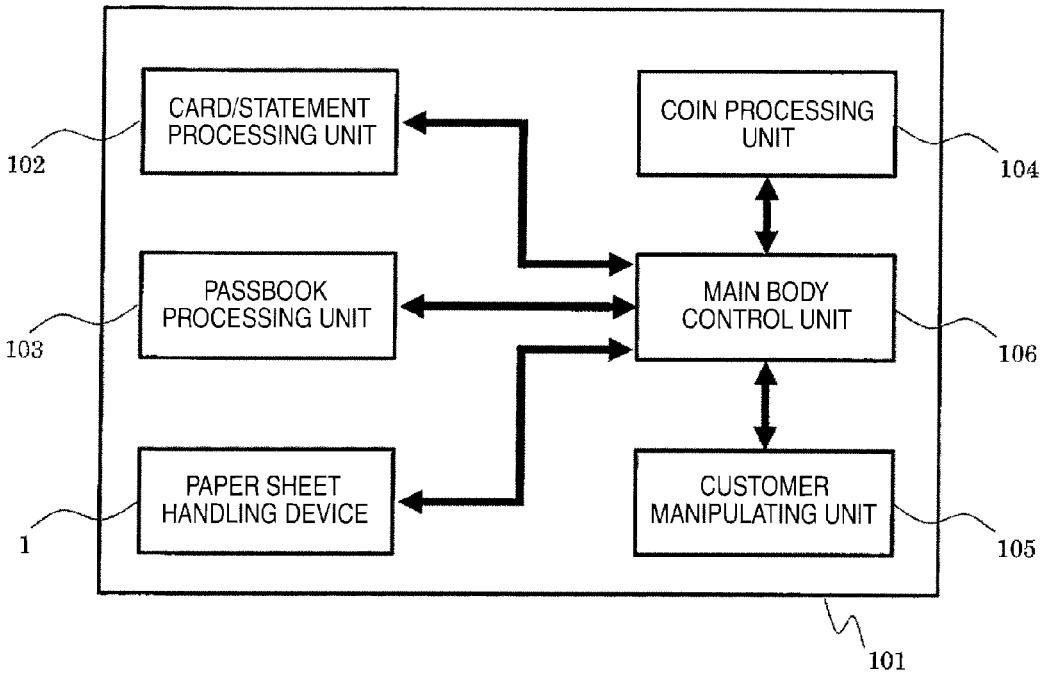
FIG. 3 A control block diagram showing a control relationship in the ATM.

FIG. 3 is a control block diagram showing a control relationship in the ATM 101.

The ATM 101 includes the card/statement processing unit 102, the passbook processing unit 103, a bill receipt/payment machine 1, the coin processing unit 104, the customer manipulating portion 105, and a main body control unit 106. In the card/statement processing unit 102, the passbook processing unit 103, the bill receipt/payment machine 1, the coin processing unit 104, and the customer manipulating portion 105 carry out the necessary operations under the control by the main body control unit 106.

Figure 4:
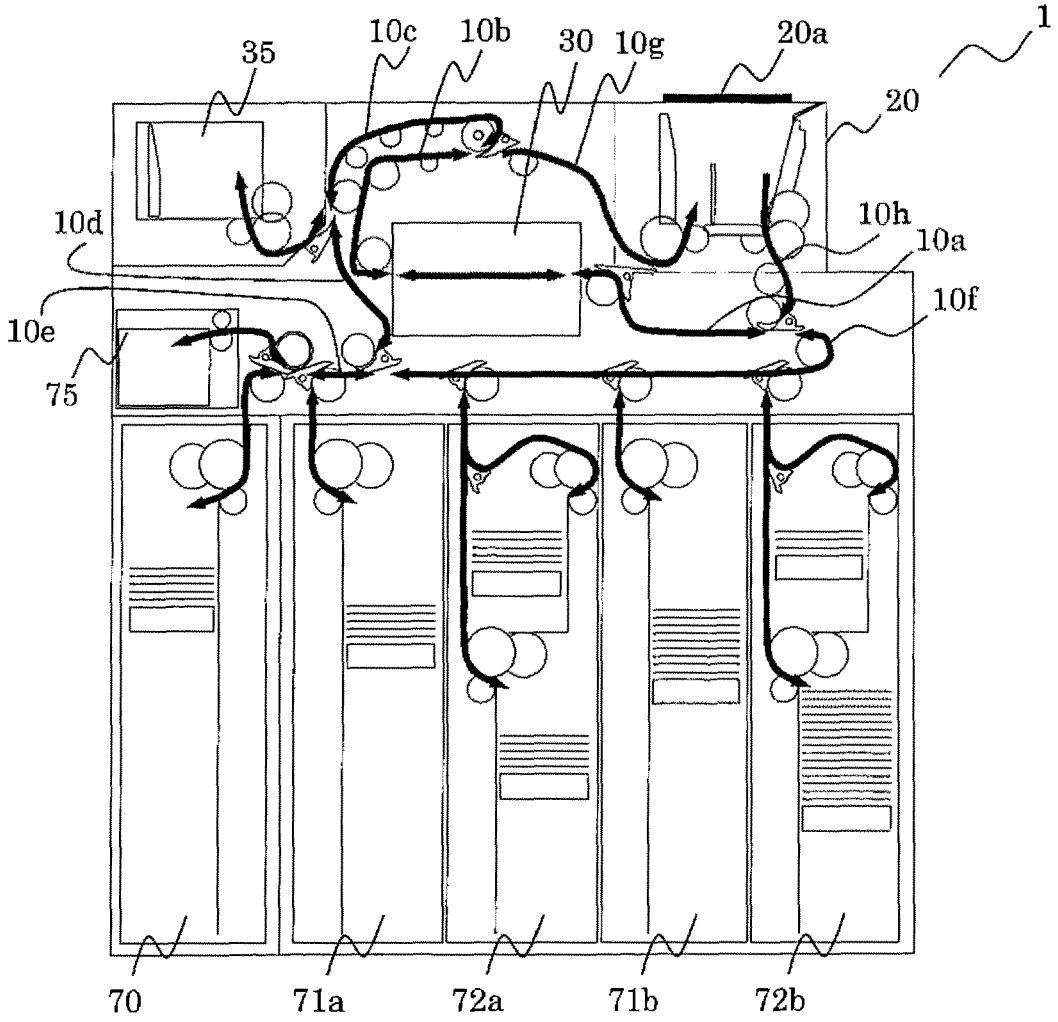
FIG. 4 An internal structural view of a bill handling device.

FIG. 4 is a side view showing an internal structure of the bill handling device 1.

A bill insert/discharge port 20 is disposed on a side of the front surface (on a side facing the user: an upper right-hand side of FIG. 4) of the upper portion of the bill handling device 1. In addition, a bill discriminating unit 30 for carrying out discrimination of the credited bills or the bills to be paid is disposed at the center portion of the bill handling device 1. A temporarily storage box 35 for temporarily storing the credited bills until the transaction is done is disposed on the upper side of a back surface side (on a side opposite to the front surface side: the upper left-hand side of FIG. 4). A reject box 75 for either storing the bills which are not subjected to the credit transaction or the payment transaction, or storing the bills which a customer forgot to pull is disposed on the lower side of the temporarily storage box 35. These mechanisms are connected to one another through bidirectional conveyance paths 10*a* to 10*f* for bidirectionally conveying the bills, and unidirectional conveyance paths 10*g*, 10*h* for unidirectionally conveying the bills.

Here, even in any of the case of the bills which are conveyed from the front to the back, and the case of the bills which are conveyed from the back to the front, the bill discriminating unit 30 can carry out the denomination discrimination and the authenticity discrimination. In a word, the bill discriminating unit 30 can carry out the denomination discrimination and the authenticity discrimination for the bills which are bidirectionally conveyed, and can discriminate whether or not the bills should be rejected.

The bill storage boxes 72*a*, 71*b*, 72*a*, 71*a* for storing the bills, and a loading box 70 for loading/recovering the bills in those bill storage boxes, thereby functioning as a bill loading unit are disposed from the front side toward the backside in the lower portion of the bill handling device 1. The bill storage box 71 (71*a* and 71*b*) is a bill storage box having a single storage unit for storing only one denomination in the inside thereof. On the other hand, the bill storage box 72 (72*a* and 72*b*) is a bill storage box including two storage units in the inside thereof.

Figure 5:
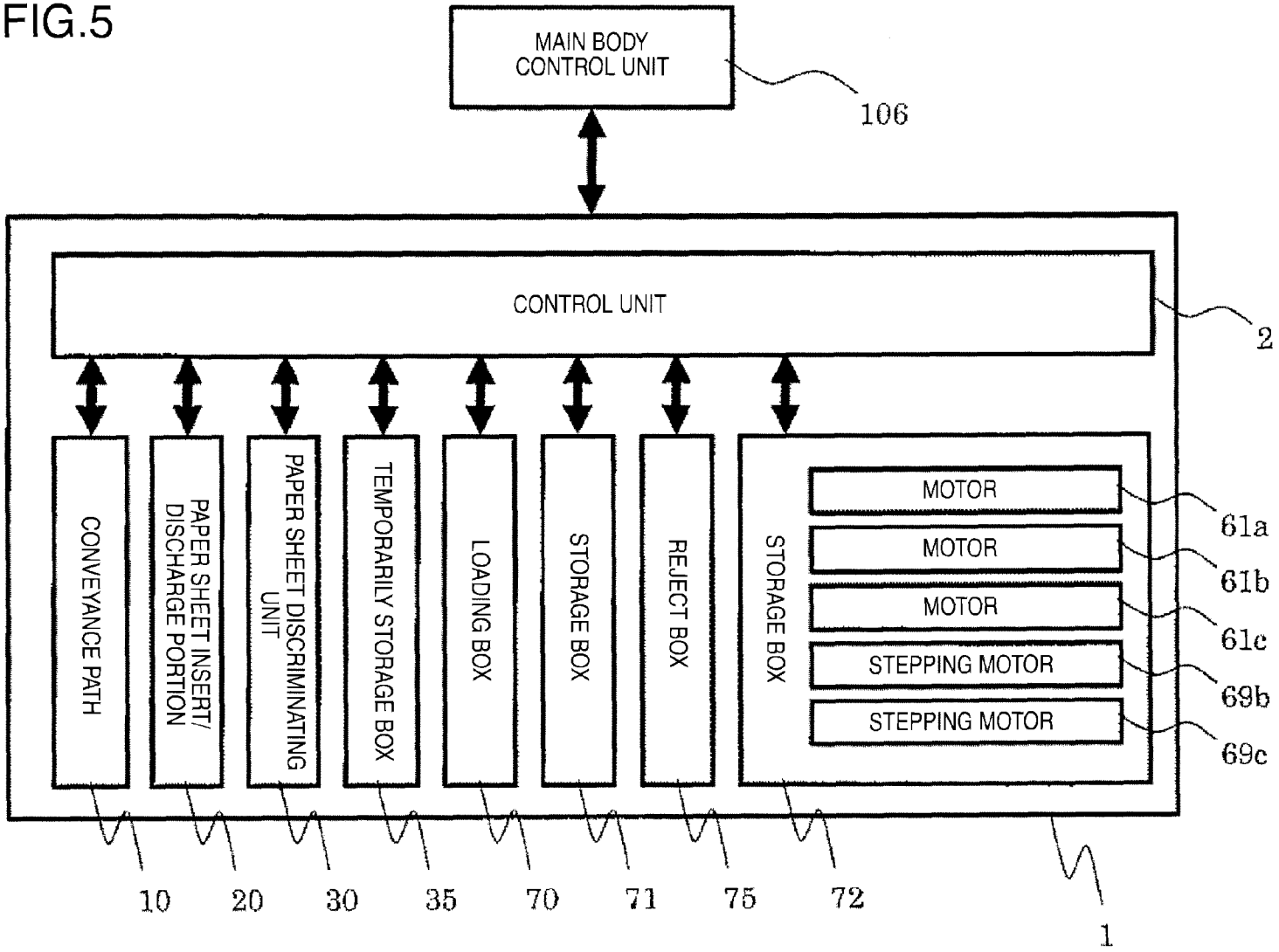
FIG. 5 A control block diagram showing a control relationship in the bill handling device.

FIG. 5 is a control block diagram showing a control relationship in the bill handling device 1.

A control unit 2 of the bill handling device 1 is connected to the main control unit 106 of the ATM 101, and carries out the control for the bill handling device 1 in accordance with an instruction issued from the main control unit 106, and the detection of the state of the bill handling device 1. In addition, the control unit 2 sends a state of the bill handling device 1 to the main body control unit 106 as may be necessary.

The bill handling device 1 has a motor for driving the units (the conveyance path 10, the bill insert/discharge port 20, the bill discriminating unit 30, the temporarily storage box 35, the loading box 70, the bill storage boxes 71, 72, the reject box 75), a solenoid, a sensor, and the like. The bill handling device 1 controls the driving of the motor, the solenoid, and the like while the state of the device is monitored by the sensor. In particular, the bill storage box 72 including the two storage units in the inside thereof has motors 61*a* to 61*c* each becoming a driving source for the conveyance, the storage/feeding, and the like, and stepping motors 69*b*, 69*c* for operating the storage mechanism(s). The two storage units can be operated independently of each other.

By the bill handling device 1 configured in the manner as described above, it becomes possible to carry out the credit transaction, the payment transaction, and the like of the bills.

Hereinafter, a description will be given with respect to the case where the bill storage boxes 71 and 72 are each operated as a recycle box for storing the bills for the credit as well as the payment. It is noted that the bill storage boxes 71 and 72 may also be each operated as either the reject box or loading box described above.

Firstly, a description will be given with respect to the operation of the bill storage box 71 including the single storage unit in the inside thereof.

Figure 6:
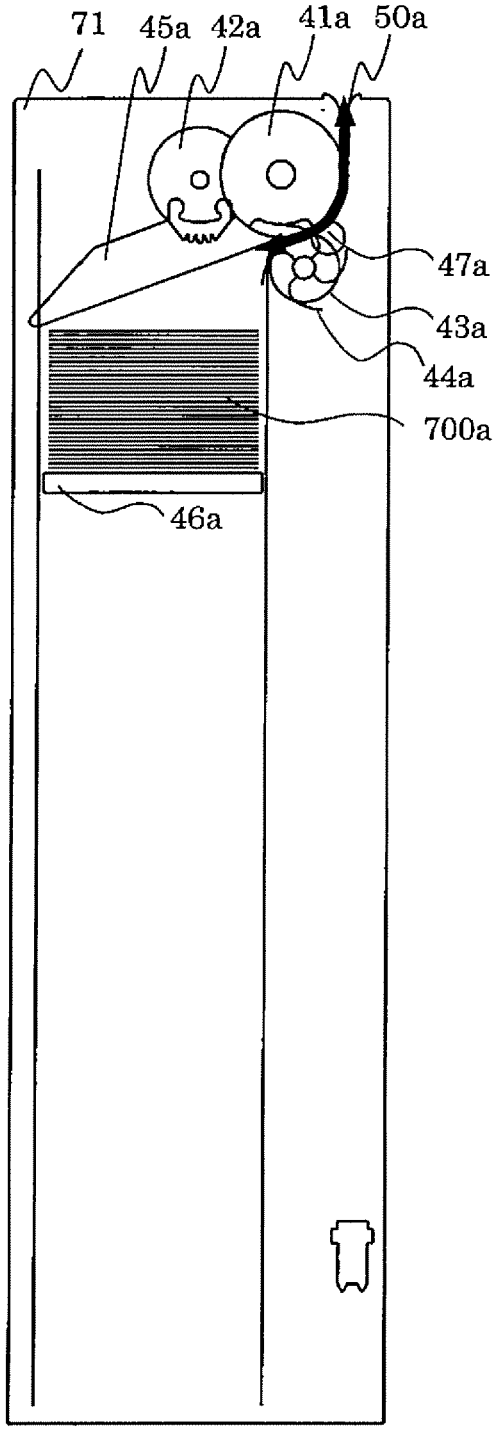
FIG. 6 A side view of a bill storage box including a single storage unit in the inside thereof.

FIG. 6 is a view showing the bill storage box 71 including the single storage unit in the inside thereof. The bill storage box 71 includes a storage unit 700*a* having a feeding/accumulation mechanical unit, and a push plate 46*a* provided approximately in a vertical direction of the storage unit 700*a*. The bill storage box 71 also includes a pinch roller 47*a*, and a bill insert/discharge port 50*a* which is provided in a top surface on a side close to the front surface of the storage box in order to carry out acceptance or delivery of the bills from or to an external conveyance path.

The feeding/accumulation mechanical unit provided in the storage unit 700*a* is composed of a feed roller 41*a*, a pickup roller 42, a gate roller 43*a*, a brush roller 44*a*, and a stack guide 45*a*. In this case, the feed roller 41*a* rotates in a phase of the operation for accumulating bills and in a phase of an operation for feeding bills, thereby conveying the bills. The gate roller 43*a* rotates in the phase of the operation for accumulating the bills, while it does not rotate in the phase of the operation for feeding the bills. The brush roller 44*a* is provided coaxially with the gate roller, and elastic members are radially disposed in the brush roller 44*a*. Also, the stack guide 45*a* can be moved in the phase of the operation for accumulating the bills and in the phase of the operation for feeding the bills.

It is noted that when the function of the bill storage box 71 is only the function of accumulating the bills, a structure may also be adopted in which the pickup roller 42*a* is not included. On the other hand, when the function of the bill storage box 71 is only the function of feeding the bills, a structure may also be adopted in which the stack guide 45*a* is not included.

Figure 7:
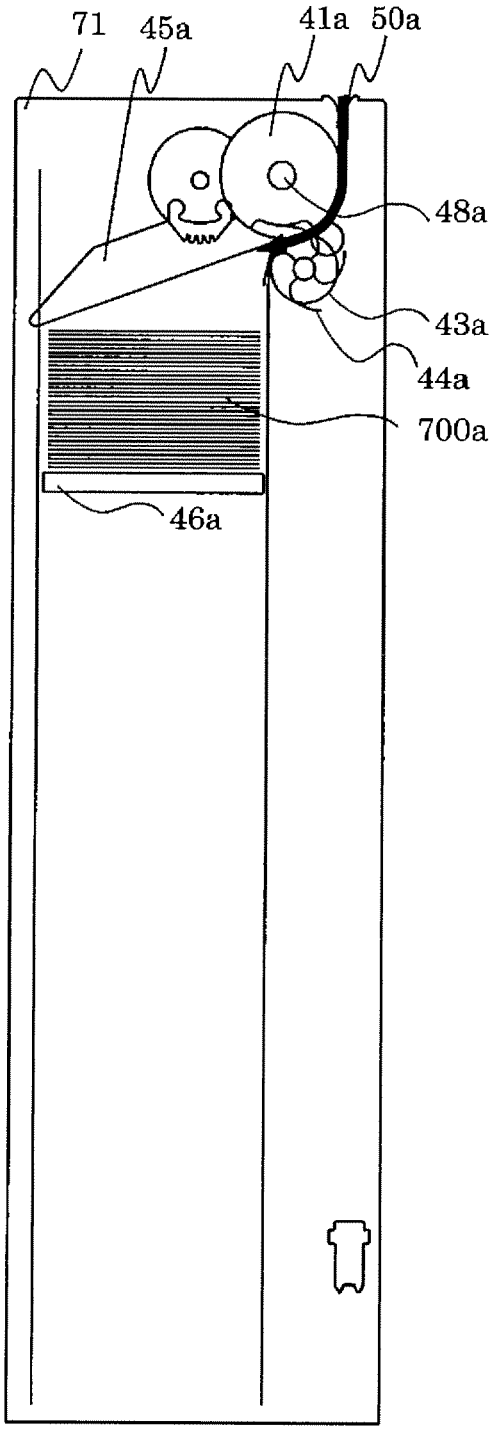
FIG. 7 A side view showing an operation for accumulating bills in the storage unit.

FIG. 7 is a view showing the operation for accumulating the bills in the storage unit 700*a*.

The bills which have been conveyed within the bill storage box 71 through the bill insert/discharge port 50*a* are discharged to the storage unit 700*a* along with the rotation of the feed roller 41*a* and the gate roller 43*a*.

Here, before the bills are discharged to the storage unit 700*a*, the push plate 46*a* is moved by a driving force of a stepping motor (not shown). The push plate 46*a* is controlled in movement in a direction in which the stored bills are moved down so as to ensure a space within the storage unit. Next, the stack guide 45*a* rotates with a shaft 48*a* of the feed roller as a fulcrum, thereby obliquely moving the stack guide 45*a*. The stack guide 45*a* is obliquely moved, which results in that the bills discharged to the storage unit 700*a* are moved along a tilt of the stack guide 45*a*.

Figure 8:
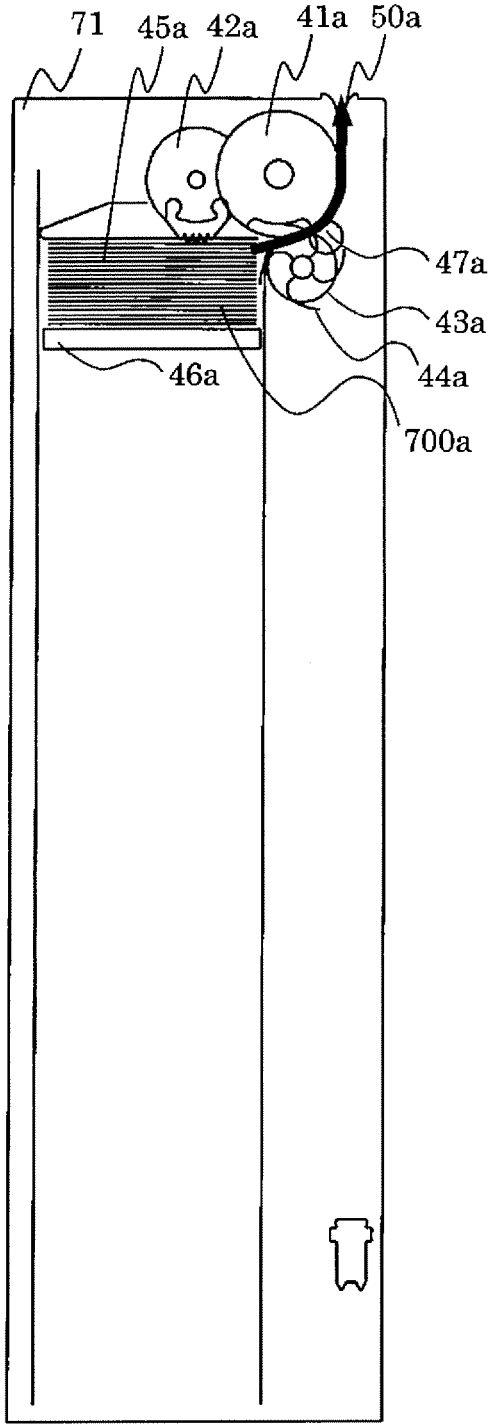
FIG. 8 A side view showing an operation for feeding bills from the storage unit.

FIG. 8 is a view showing the operation for feeding the bills from the storage unit 700*a*.

The push plate 46*a* is moved upward by the driving force of the stepping motor (not shown). The push plate 46*a* is moved upward, so that by a force of a spring or the like (not shown), the bills on the push plate 46*a* are pressed against the pickup roller 42*a* by a predetermined pressing force. It is noted that although the case where the push plate 46*a* presses the bills has been described here, a structure may also be adopted in which the pickup roller 42*a* presses the bills.

As described above, the pickup roller 42*a* rotates in the state in which the pressing force is applied between the pickup roller 42*a* and the bills, whereby the bills contacting the pickup roller 42*a* can be fed from the storage unit 700*a*. The bills which have been fed from the storage unit 700*a* are sent away by the rotating feed roller 41*a*. Also, the bills pass through the pinch roller 47*a* while double-feeding is prevented by the gate roller 43*a* which does not rotate in the feeding direction, and are conveyed one sheet by one sheet from the bill insert/discharge port 50*a* to the outside of the bill storage box. After the sending-away of a predetermined number of sheets of bills to the outside of the bill storage box has been completed, the driving of the feed roller 41*a* is stopped.

Next, a description will be given with respect to the operation of the bill storage box 72 including the two storage units in the inside thereof.

Figure 9:
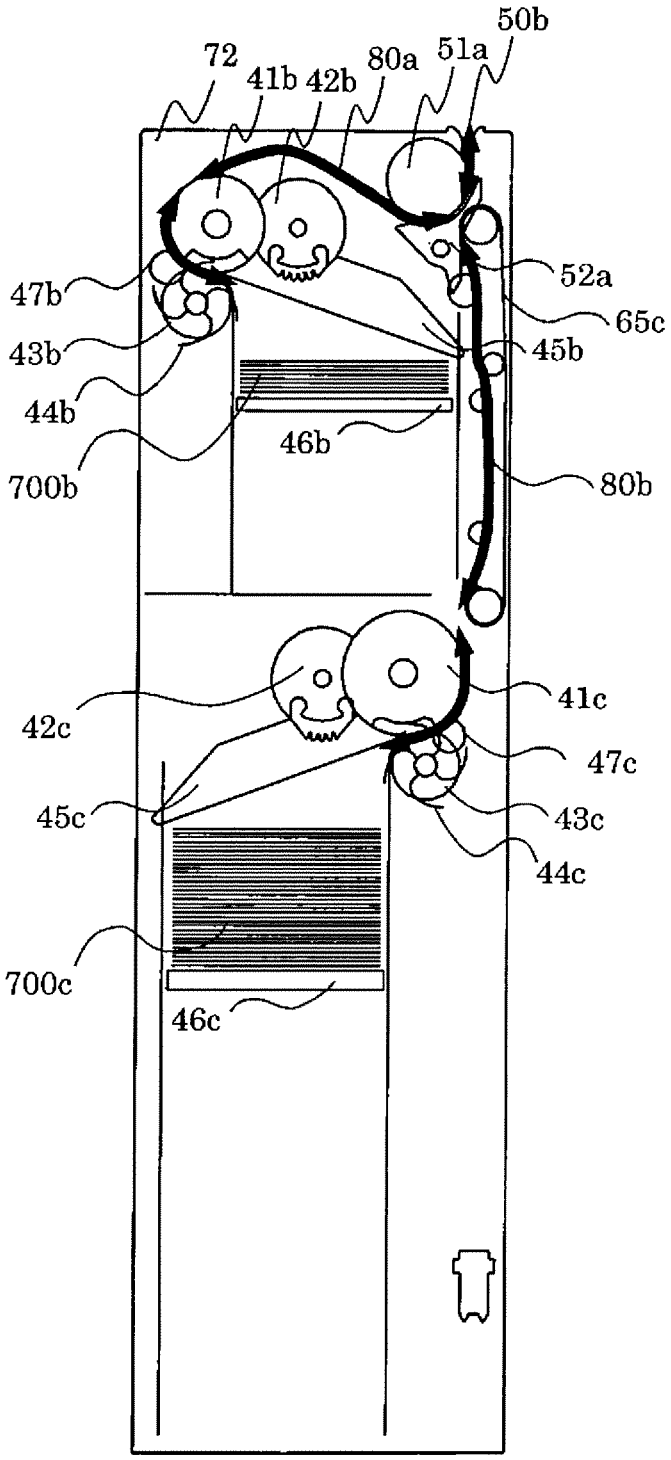
FIG. 9 A side view of a bill storage box including two storage units in the inside thereof.

FIG. 9 is a view showing the bill storage box 72 including the two storage units in the inside thereof. The bill storage box 72 includes an upper storage unit 700*b* and a lower storage unit 700*c* each having the feeding/accumulation mechanical unit, and a push plate 46*b* (and a push plate 46*c*) which is provided approximately in the vertical direction of an upper storage unit 700*b* (and a lower storage unit 700*c*). The bill storage box 72 also includes pinch rollers 47*b* and 47*c*, and a bill insert/discharge port 50*b* which is provided on an upper surface on a side close to the front surface of the storage box in order to carry out the acceptance or delivery of the bills from or to an external conveyance path. The upper storage unit 700*b* and the lower storage unit 700*c* are stacked and disposed in this order from a position close to the bill insert/discharge port 50*b*.

The feeding/accumulation, mechanical unit provided in each storage unit 700 (700*b*, 700*c*) is composed of a feed roller 41 (41*b*, 41*c*), a pickup roller 42 (42*b*, 42*c*), a gate roller 43 (43*b*, 43*c*), a brush roller 44 (44*b*, 44*c*), and a stack guide 45 (45*b*, 45*c*) similarly to the feeding/accumulation mechanical unit provided in the storage unit 700*a* of the bill storage box 71 including the single storage unit in the inside thereof. In particular, the upper storage unit 700*b* has a structure in which the bills are inserted from the back surface side (from the left-hand side of FIG. 9) of the bill storage box 72 to the inside of the storage unit. Thus, the feeding/accumulation mechanical unit provided in the upper storage unit 700*b* is provided on the back surface side of the bill storage box 72.

The bill insert/discharge port 50*b* is an insert/discharge port which is common to the upper storage unit 700*b* and the lower storage unit 700*c*. A roller 51*a* for inserting/discharging the bills from/to the outside of the storage box is provided in a position adjacent to the insert/discharge port 50*b* concerned. The roller 51*a*, the feed roller 41*b*, and the gate roller 42*b* are disposed approximately at the same height, thereby preventing a decrease in a volume of the upper storage unit 700*b*.

The bill insert/discharge port 50*b*, the upper storage unit 700*b*, and the lower storage unit 700*c* are connected to one another through an internal conveyance path which can convey the bills in the bidirectional direction. Specifically, the internal conveyance path includes an internal conveyance path 80*a*, and an internal conveyance path 80*b*. In this case, the internal conveyance path 80*a* conveys the bills approximately in a horizontal direction (in an anteroposterior direction of the bill storage box). Also, the internal conveyance path 80*b* conveys the bills approximately in a vertical direction (in a direction perpendicular to the front and back of the bill storage box). The internal conveyance path 80*b* is structured in such a way that the bills are conveyed while a driven roller is pressed against a conveyance belt 65*c* disposed on one side, whereby a width of the conveyance path in the anteroposterior direction is limited to the minimum necessary. In addition, a sorting gate 52*a* for sorting the bills into the internal conveyance path 80*a* or the internal conveyance path 80*b* is disposed just under the roller 51*a*.

It is noted that when the function of the bill storage box 72 is only the junction of accumulating the bills, a structure may also be adopted in which the pickup roller 42 (42*b*, 42*c*) is not included. On the other hand, when the function of the bill storage box 72 is only the function of feeding the bills, a structure may also be adopted in which the stack guide 45 (45*b*, 45*c*) is not included. In addition, when the function of the bill storage box 72 is only one of the function of accumulating the bills or the function of feeding the bills, the internal conveyance paths 80*a* and 80*b* may also be made a conveyance path which can convey the bills only in one direction.

As shown in FIG. 9, the feeding/accumulation mechanical unit provided in the upper storage unit 700*b* is disposed on the back surface side of the bill storage box 72. On the other hand, the bill insert/discharge port 50*b*, the sorting gate 52*a*, and the internal conveyance path 80*b* are disposed on the front surface side of the bill storage box 72. The feeding/accumulation mechanical unit and the sorting gate 52*a* which are provided in the upper storage unit 700*b* are disposed in the different positions, respectively, thereby making it possible to narrow a space between the sorting gate 52*a* and the upper storage unit 700*b*, which leads to the miniaturization of the bill storage box 72. In addition, the feeding/accumulation mechanical unit provided in the upper storage unit 700*b* is disposed on the back surface side of the bill storage box 72, and the bill insert/discharge port 50*b* is disposed on the front surface side of the bill storage box 72. As a result, a space just below the sorting gate 52*a* can also be utilized as a part of a space of the upper storage unit 700*b*. For this reason, even in the case of the bill storage box having the sorting gate 52*a*, the space of the inside of the storage box can be efficiently utilized, which leads to the miniaturization of the bill storage box 72.

It is noted that as described above, the feeding/accumulation mechanical unit provided in the upper storage unit 700*b* is provided on the back surface side of the bill storage box 72 and the space between the sorting gate 52*a* and the upper storage unit 700*b* is narrowed, and as a result, the upper storage unit 700*b* is disposed so as to be eccentrically located on the front surface (on the right-hand side of FIG. 9) of the bill storage box 72. On the other hand, since the feeding/accumulation mechanical unit is provided on the front surface of the bill storage box, the lower storage unit 700*c* is disposed so as to be eccentrically located on the back surface of the bill storage box 72.

Figure 10:
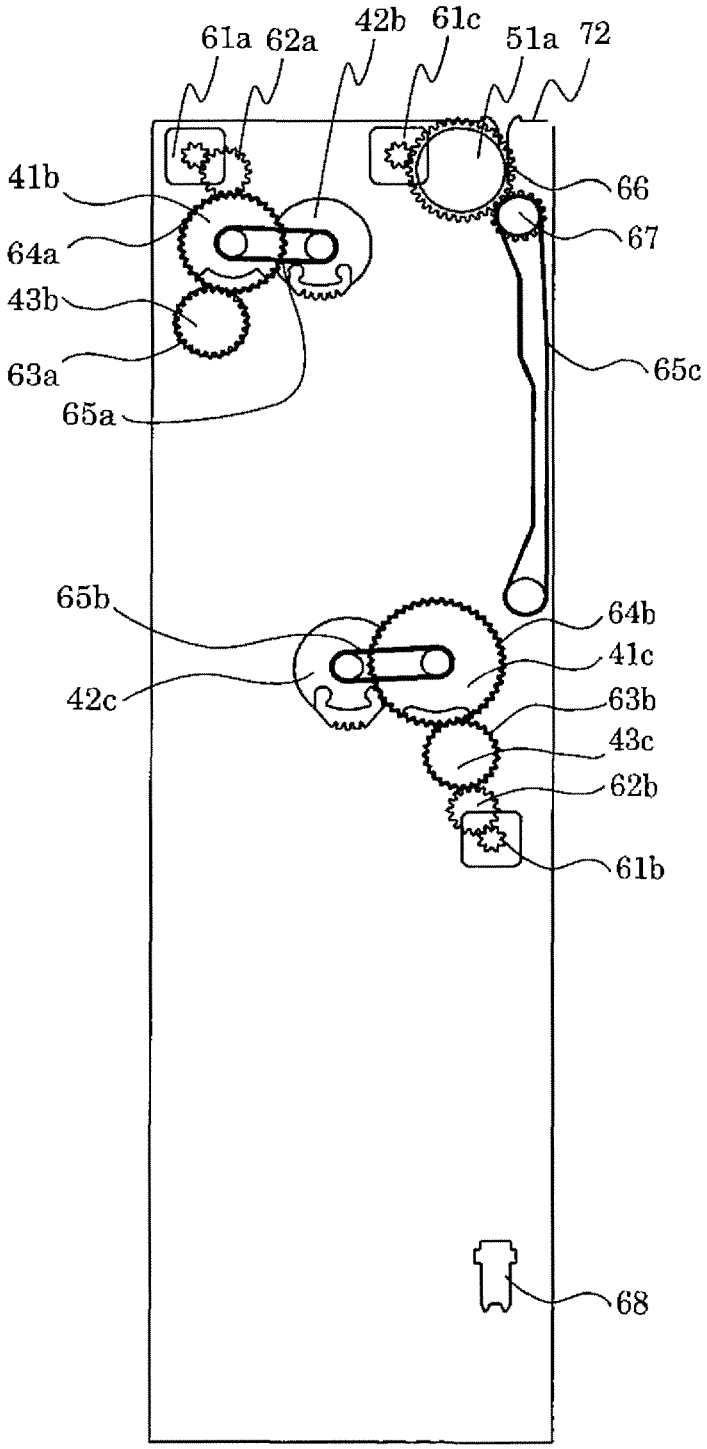
FIG. 10 A side view showing means for driving the bill storage box including the two storage units in the inside thereof.

FIG. 10 is a view showing means for driving feeding/accumulation operating units which are provided in the upper storage unit 700*b* and the lower storage unit 700*c*, respectively, the roller 51*a*, and the conveyance belt 68. Of the constituent components or parts of the feeding/accumulation operating unit, the feed roller 41 (41*b*, 41*c*) and the gate roller 43 (43*b*, 43*c*) are transmitted in driving from a DC motor 61 (61*a*, 61*b*) via a driving transmitting gear 62 (62*a*, 62*b*), a driving transmitting gear 63 (63*a*, 63*b*), and driving transmitting gear 64 (64*a*, 64*b*), In addition, the pickup roller 42 is transmitted in driving from the DC motor 61 (61*a*, 61*b*) via the driving transmitting gear 62 (62*a*, 62*b*), the driving transmitting gear 64 (64*a*, 64*b*), and a timing belt 65 (65*a*, 65*b*). Moreover, the roller 51*a* and the conveyance belt 65*c* are transmitted in driving from the DC motor 61*c* via a driving transmitting gear 66 and a driving transmitting gear 67.

It is noted that the supply of the electric portion to the DC motors and the sensor (not shown), and the transmission/reception of the electric signal(s) to/from the outside are carried out through a connector 68 provided in the lower portion of the bill storage box 72.

Figure 11:
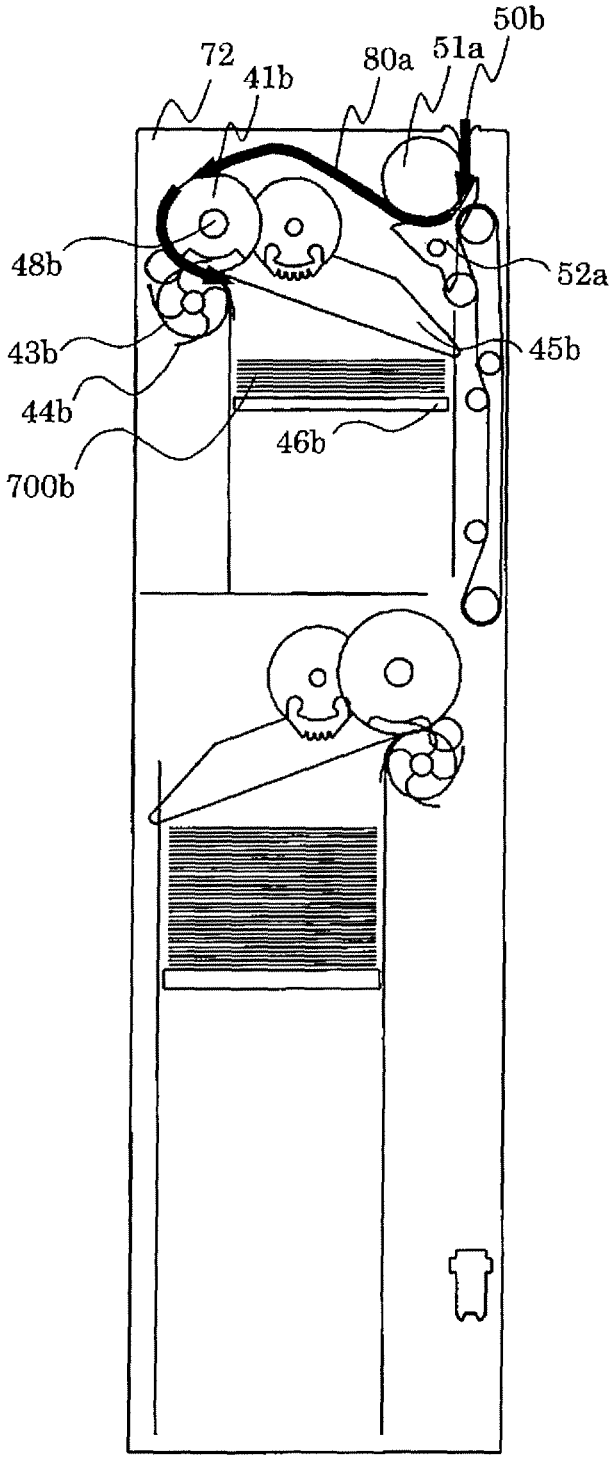
FIG. 11 A side view showing an operation for accumulating bills in an upper storage portion.

FIG. 11 is a view showing an operation for accumulating the bills in the upper storage unit 700*b*.

The bills which have been conveyed within the bill storage box 72 through the bill insert/discharge port 50*b* are conveyed to the internal conveyance path 80*a* by the roller 51*a* and the sorting gate 52*a*. After that, the conveyance direction is changed by the feed roller 41*b* in such a way that two sides of each bill are reversed, and the bills are discharged to the upper storage unit 700*b*.

Here, before the bills are discharged to the upper storage unit 700*b*, the push plate 46*b* is moved by a driving force of the stepping motor 69*b* (not shown). The push plate 46*b* is controlled in movement in the direction, in which the stored bills are moved down so as to ensure the space within the storage unit. Next, the stack guide 45*b* rotates with a shaft 48*b* of the feed roller as a fulcrum, thereby obliquely moving the stack guide 45*b*. The stack guide 45*b* is obliquely moved, which results in that the bills discharged to the upper storage unit 700*b* are moved along a tilt of the stack guide 45*b*. In addition, a speed at which the bills are taken in by the feed roller 41*b* is preferably faster than or equal to a conveyance speed of the bills by the internal conveyance path 80*a*. In this embodiment, the speed at which the bills are taken in by the feed roller 41*b* is made approximately equal to the conveyance speed of the bills by the internal conveyance path 80*a*.

Figure 12:
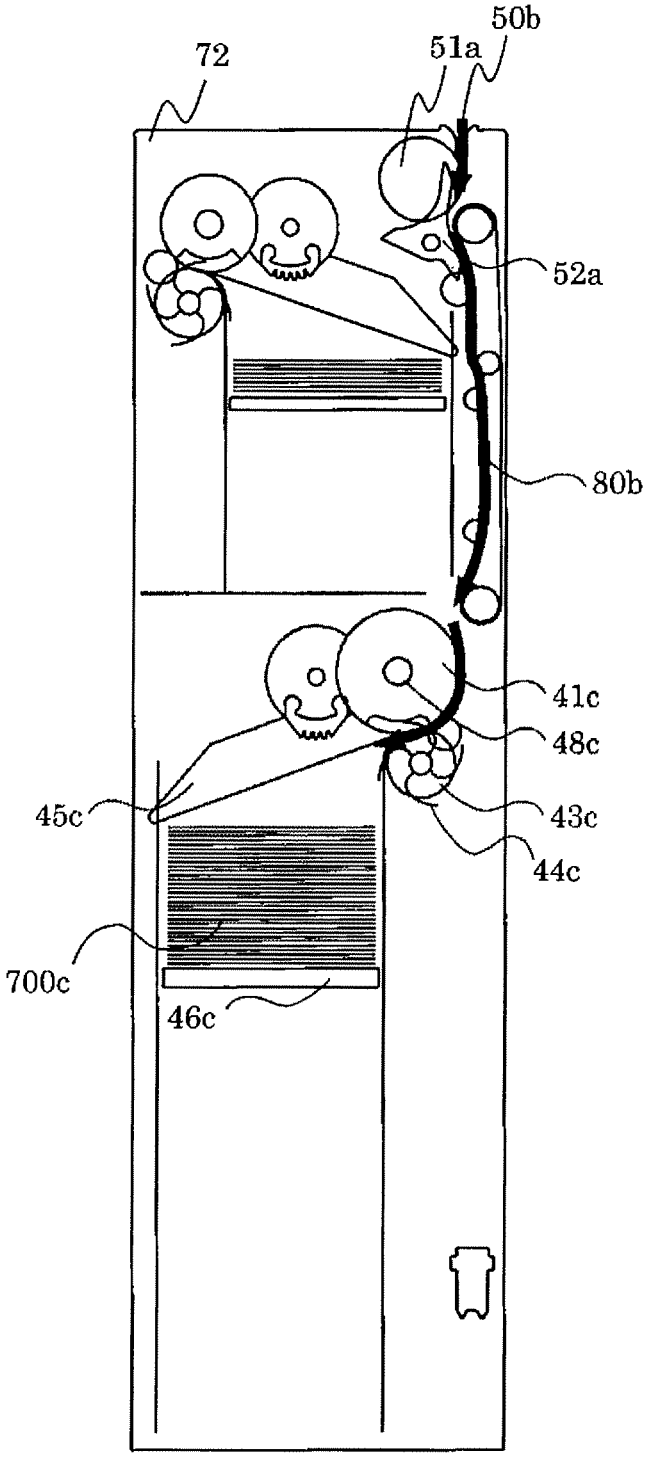
FIG. 12 A side view showing an operation for accumulating bills in a lower storage unit.

FIG. 12 is a view showing the operation for accumulating the bills in the lower storage unit 700*c*.

The bills which have been conveyed within the bill storage box 72 through the bill insert/discharge port 50*b* are conveyed to the internal conveyance path 80*b* by the roller 51*a* and the sorting gate 52*a*. After that, the bills are discharged to the lower storage unit 700*c* by the feed roller 41*c*.

Here, before the bills are discharged to the lower storage unit 700*c*, the push plate 46*c* is moved by the driving force of the stepping motor 69*c* (not shown). The push plate 46*c* is controlled in movement in the direction in which the stored bills are moved down so as to ensure the space within the storage unit. Next, the stack guide 45*c* rotates with the shaft 48*c* of the feed roller as a fulcrum, thereby obliquely moving the stack guide 45*c*. The stack guide 45*c* is obliquely moved, which results in that the bills discharged to the lower storage unit 700*c* are moved along a tilt of the stack guide 45*c*. In addition, a speed at which the bills are taken in by the feed roller 41*c* is preferably faster than or equal to a conveyance speed of the bills by the internal conveyance path 80*b*. In this embodiment, the speed at which the bills are taken in by the feed roller 41*b* is made approximately equal to the conveyance speed of the bills by the internal conveyance path 80*b*.

Figure 13:
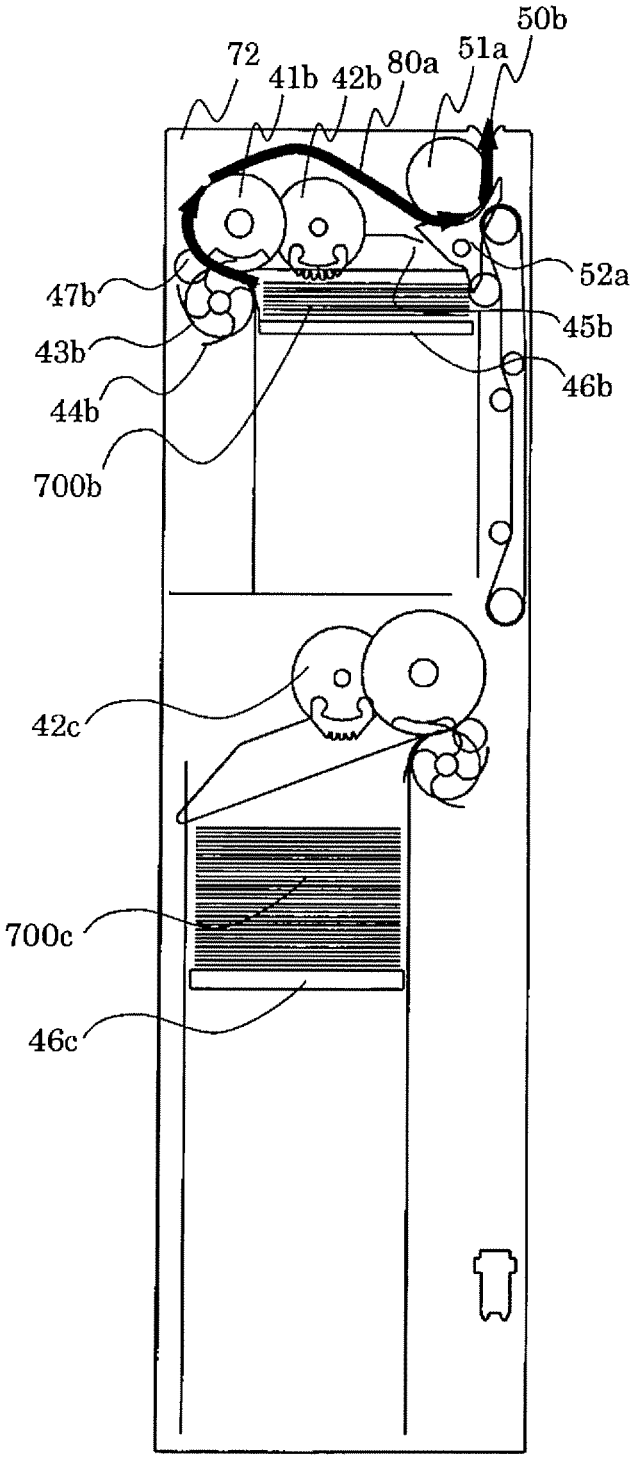
FIG. 13 A side view showing an operation for feeding bills from the upper storage unit.

FIG. 13 is a view showing the operation for feeding the bills from the upper storage unit 700*b*.

The push plate 46*b* is moved upward by a driving force of the stepping motor 69*b* (not shown). The push plate 46*b* is moved upward, which results in that the bills on the push plate 46*b* is pressed against the pickup roller 42*b* with a predetermined pressing force by a force of a spring or the like (not shown). On the other hand, in the lower storage unit 700*c*, the pickup roller 42*c* moves downward the push plate 46*c* to a position where the push plate 46*c* does not contact the bills within the lower storage unit 700*c* so as not to feed the bills.

The bills which have been fed from the upper storage unit 700*b* by the pickup roller 42*b* are sent away by the rotating feed roller 41*b*. Then, the bills are sent away to the internal conveyance path 80*a* through a pinch roller 47*b* while the double-feeding is prevented by the gate roller 43*b* which does not rotate in the feeding direction. After that, the bills are conveyed one sheet by one sheet from the bill insert/discharge port 50*b* to the outside of the bill storage box by the roller 51*a* and the sorting gate 52*a*.

After the sending-away of a predetermined number of sheets of bills to the internal conveyance path 80*a* has been completed, the driving of the feed roller 41*b* is stopped. Subsequently, after all of the bills on the internal conveyance path 80*a* have been conveyed to the outside of the bill storage box, the driving of the internal conveyance path 80*a* and the roller 51*a* is stopped.

Figure 14:
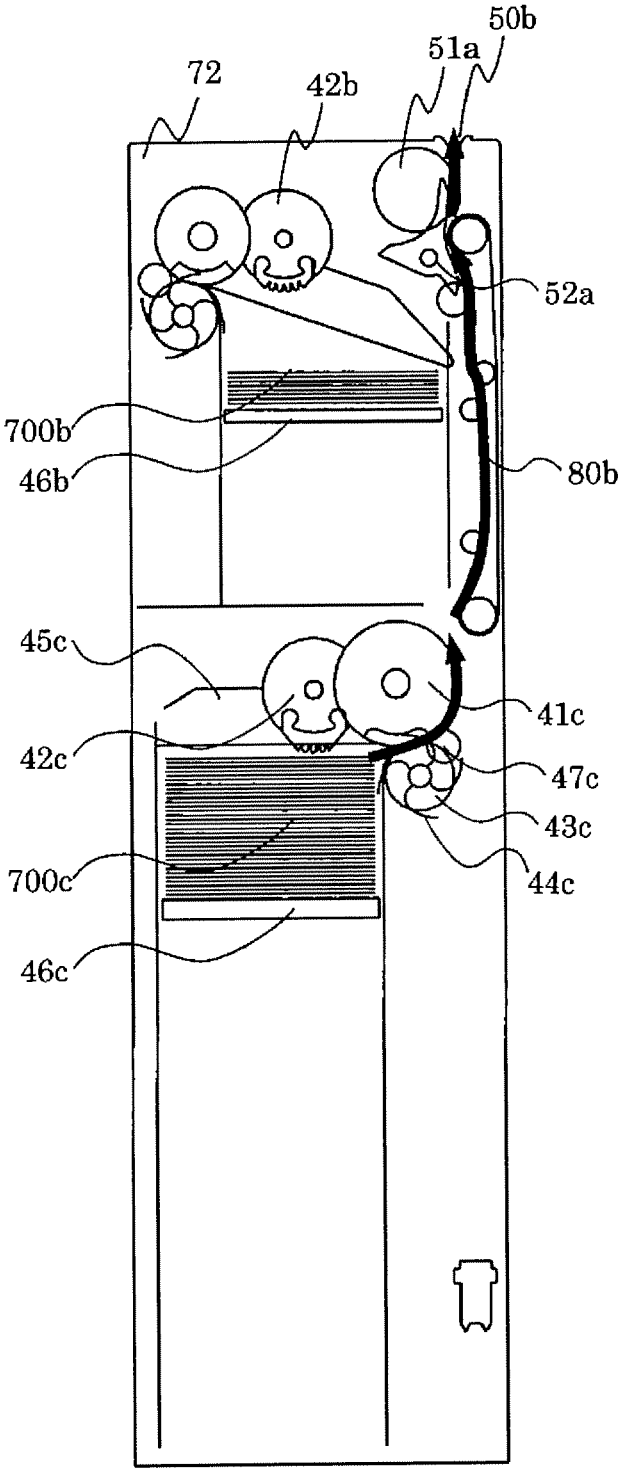
FIG. 14 A side view showing an operation for feeding bids from the lower storage unit.

FIG. 14 is a view showing the operation for feeding the bills from the lower storage box 700*c*.

The pitch plate 46*c* is moved upward by a driving force of the stepping motor 69*c* (not shown). The push plate 46*c* is moved upward, which results in that the bills on the push plate 46*c* are pressed against the pickup roller 42*c* with a predetermined pressing force by a force of a spring or the like (not shown). On the other hand, in the lower storage unit 700*b*, the pickup roller 42*b* moves downward the push plate 46*b* to a position where the push plate 46*b* does not contact the bills within the lower storage unit 700*b* so as not to feed the bills.

The bills pressed against the pickup roller 42*c* are sent away by the rotating feed roller 41*c*. Then, the bills are sent away to the conveyance path 80*b* through a pinch roller 47*c* while the double-feeding is prevented by the gate roller 43*c* which does not rotate in the feeding direction. After that, the bills are conveyed one sheet by one sheet from the bill insert/discharge port 50*b* to the outside of the bill storage box by the roller 51*a* and the sorting gate 52*a*.

After the sending-away of a predetermined number of sheets of bills to the conveyance path 80*b* has been completed, the driving of the feed roller 41*c* is stopped. Subsequently, after ail of the bills on the conveyance path 80*b* have been conveyed to the outside of the bill storage box, the driving of the conveyance path 80*b* and the roller 51*a* is stopped.

Of the bill handling device structured in the manner as described above, the storage boxes: the hill storage box 71; and the bill storage boxes 72 are structured in external dimensions, positions of the bill insert/discharge ports (50*a*, 50*b*), shape of the bill insert/discharge port, and the like in the form of the common structure. As a result, the storage boxes of the bill storage boxes 71, 72 can be given the compatibility. Also, a combination of the bill storage boxes 71, 72 can be freely changed in accordance with the operation situations of the countries, thereby installing the bill storage boxes 71, 72 in the tray 110.

For example, the four kinds of bills; a 10000-yen bill; a 5000-yen bill; a 2000-yen bill; and a 1000-yen bill are present as the bills which circulate within Japan. In this case, such an operation can be carried out that the 10000-yen bills and the 1000-yen bills the trading volumes of which are large are stored in the bill storage box 71 having the single storage unit in the inside thereof, and the 5000-yen bills and the 2000-yen bills the trading volumes of which are small are stored together with each other in the bill storage box 72 having the two storage units in the inside thereof.

Next, a description will be given with respect to the door which is provided in the bill storage box 72 in order to carry out the loading and taking-out of the bills within the upper storage unit 700*b* and the lower storage unit 700*c*.

Figure 15:
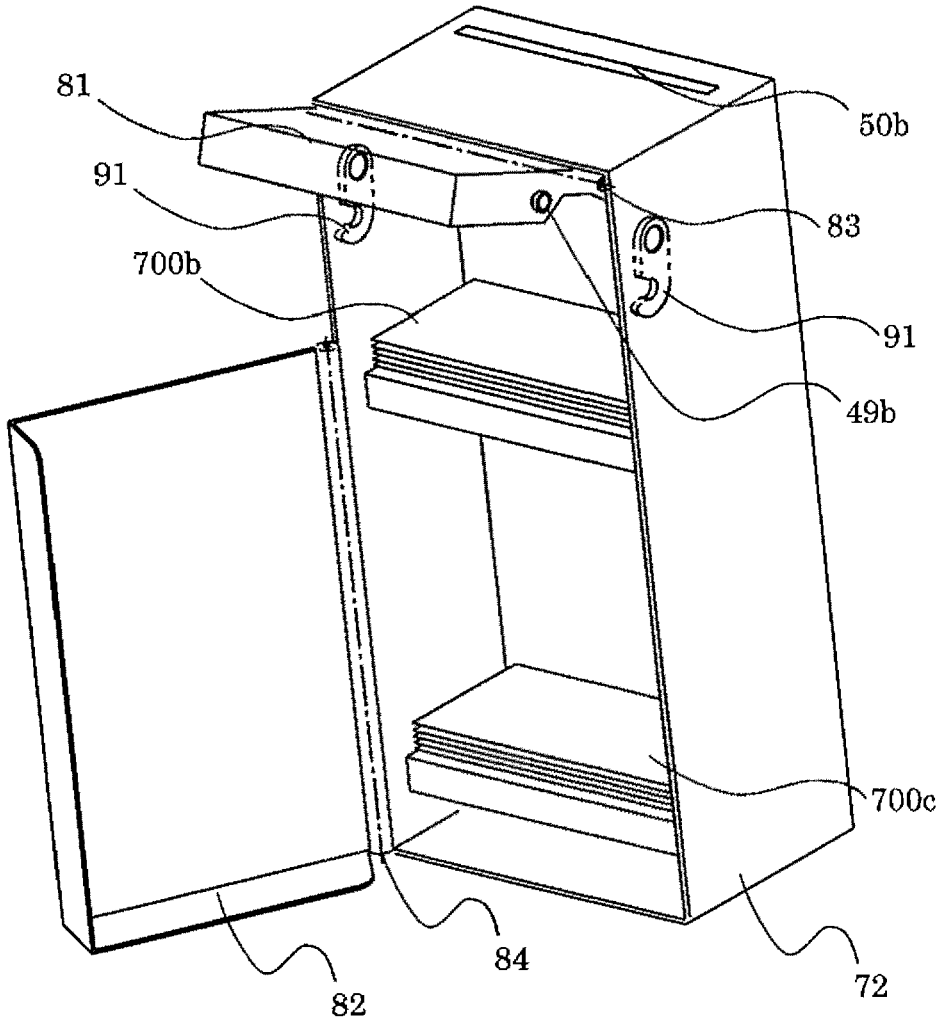
FIG. 15 An external appearance perspective view of a bill storage box including two storage units in the inside thereof.

FIG. 15 is an external appearance perspective view of the bill storage box 72. An upper door 81 for carrying out the loading and taking-out of the bills within the upper storage unit 700*b*, and a lower door 82 for carrying out the loading and taking-out of the bills within the bill storage space 700*c* are provided in the bill storage box 72. The upper door 81 and the lower door 82 which are provided in the back surface of the storage box can be opened and closed independently of each other. Thus, the loading and taking-out of the bills within the upper storage unit 700*b* and the lower storage unit 700*c* can be carried out as may be necessary.

In addition, the upper door 81 was structured in such a way that the upper door 81 rotated with a rotating shaft 83 with a fulcrum to be opened and closed (hereinafter, vertical opening). On the other hand, the lower door 82 was structured in such a way that the upper door 82 rotated with a rotating shaft 84 disposed in a corner portion of the bill storage box 72 as a fulcrum to be opened and closed (hereinafter, horizontal opening). That is to say, the upper door 81 and the lower door 83 have the structures in which the opening and closing directions of them are different from each other.

The reason why the upper door 81 has the vertical opening style will be described. The feed roller 43*b* and the stack guide 45*b* operate in conjunction with each other through the shaft 48*b* of the feed roller. Therefore, the feed roller 41*b* is desirably left inside the bill storage box 72 irrespective of the opening and closing of the upper door 81. In addition, since the user is hard to insert and take out the bills when the gate roller 43*b* is present inside the bill storage box 72, desirably, the gate roller 43*b* and the upper door 81 are evacuated in conjunction with each other.

When as described above, the feed roller 41*b* is left inside the storage box, and the gate roller 43*b* is moved in conjunction with the upper door 81, there is the possibility that if the upper door 81 is subjected to the horizontal opening, then, the upper door 81 is shifted in a direction in which the shaft 48*b* of the feed roller, and the shaft 49*b* of the gate roller intersect with each other when, for example, an error occurs due to a tolerance in a phase of a design or a temporal change, which poses an impediment in the phase of the conveyance of the bills. On the other hand, the structure is adopted in which when the upper door 81 is subjected to the vertical opening, even if the error occurs due to the tolerance in the phase of the design or the temporal change, the problem as described above is hard to cause.

Figure 16:
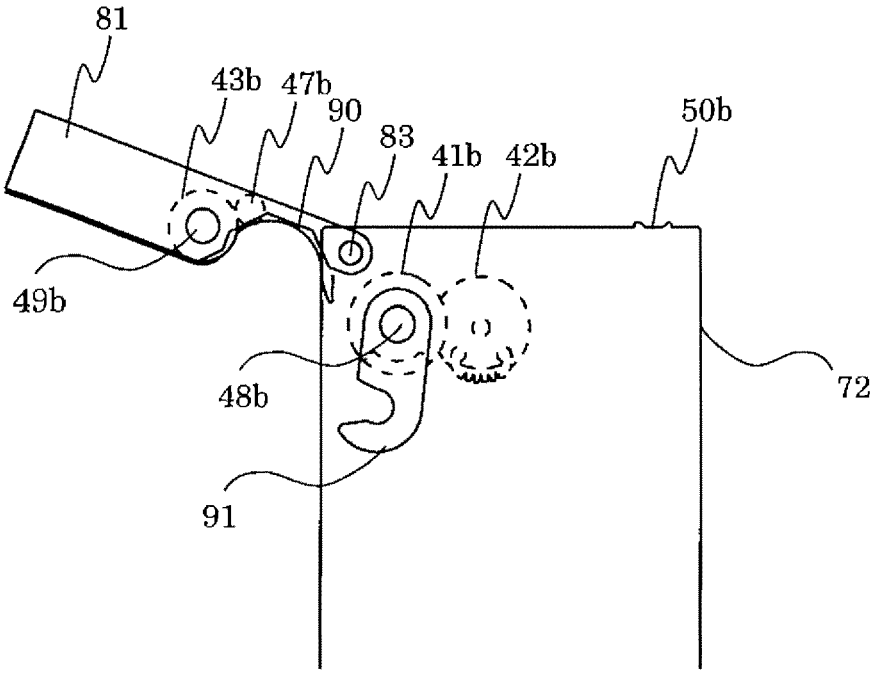
FIG. 16 A side view showing the bill storage box when an upper door is opened.
Figure 17:
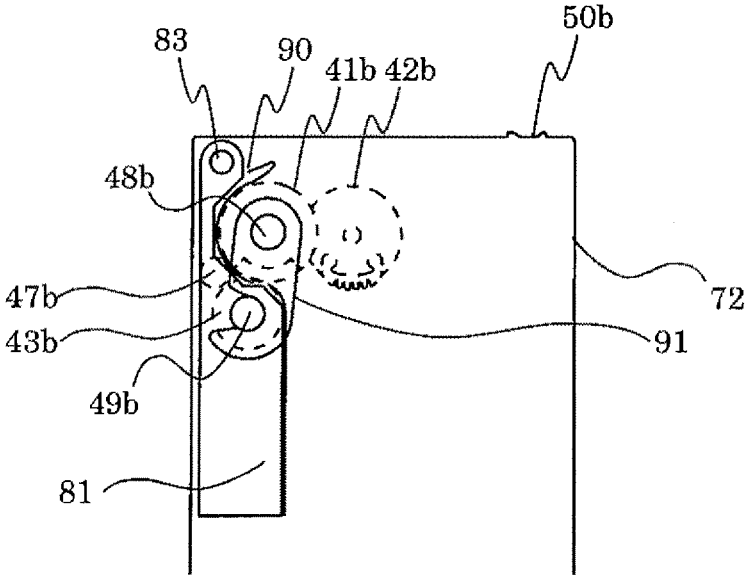
FIG. 17 A side view showing the bill storage box when the upper door is closed.

FIG. 16 and FIG. 17 are respectively side views showing the bill storage box 72 when the upper door 81 is opened, and the bill storage box 72 when the upper door 81 is closed. At this time, the structure is adopted in which since the gate roller 43*b*, the pinch roller 47*b*, and the conveyance guide 90 for the upper storage unit 200*b* are evacuated in conjunction with the upper door 81, the user is easy to insert and take out the bills in the phase of the loading of the bills, and in the phase of the taking-out of the bills.

In addition, a shaft position plate 91 is disposed in two portions: the inside of the bill storage box 72; and the outside of the internal conveyance path 80*a* of the bills. A shaft-to-shaft distance between the shaft 48*b* of the teed roller, and the shaft 49*b* of the gate roller is precisely fixed by the shaft position plate 91. For the purpose of reducing the force for opening and closing the door 82, an area of contact between the shaft position plate 91 and the shaft 49*b* of the gate roller is limited to the minimum necessary to the extent that the shaft 49*b* of the gate roller can be pinched.

By adopting the structure as described above, the width in the anteroposterior direction of the bill storage box including the plural storage units in the inside thereof can be miniaturized to the same extent as that of the bill storage box having the single storage unit in which only one denomination is stored in the inside thereof. In addition, the bill storage box including the plural storage boxes in the inside thereof or the bill storage box including the single storage box in the inside thereof is arbitrarily selected and is installed in the tray 110, which results in that it is possible to provide the bill handling device which can carry out the flexible response in accordance with the operation situations of the countries.

Next, a description will be given with respect to a procedure for removing away the bills when the bills conveyed to the internal conveyance path 80*b* are retained (jammed) due to some sort of cause.

When the bills conveyed to the internal conveyance path 80*b* are retained (jammed), a sensor (not shown) provided in the internal conveyance path 80*b* detects that the bills have been retained or the bills have not reached. When it is detected that the bills have been retained or the bills have not reached, the driving of the DC motor 61 (61*a*, 61*b*, 61*c*) is stopped, thereby stopping the conveyance of the bills. After that, the bill storage box 72 is taken out from the tray 110.

Figure 18:
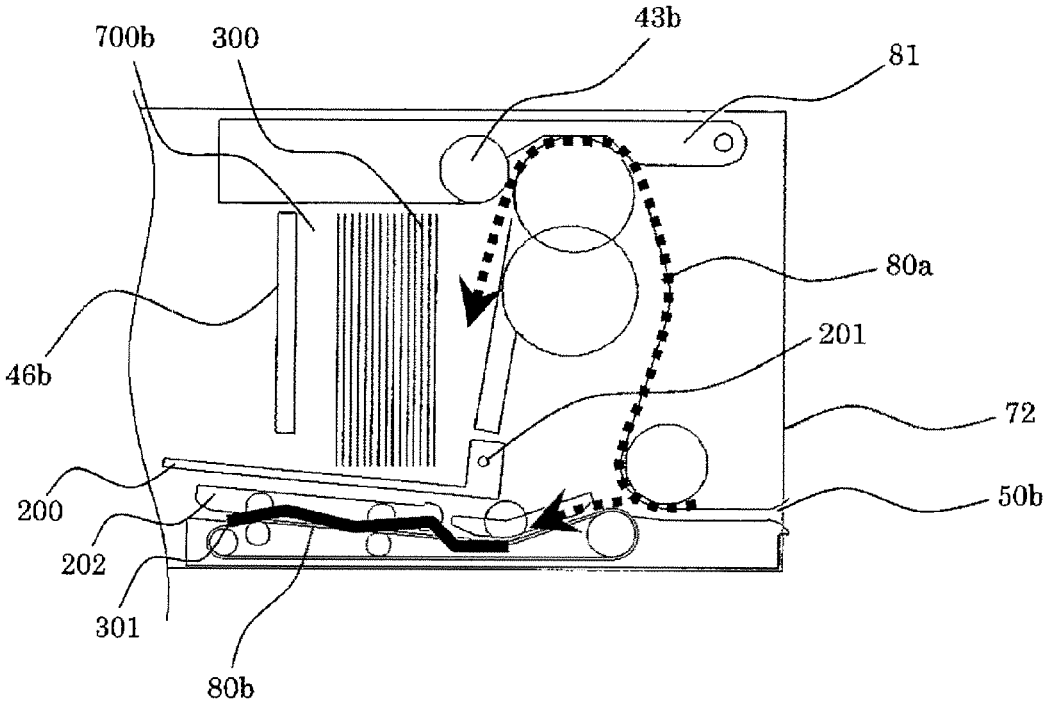
FIG. 18 A side view showing a bill storage box of a first embodiment.

FIG. 18 is a side view in which the back surface of the storage box is made the upper surface (an upside of the figure), and the front surface of the storage box is made the bottom surface (a downside of the figure), and is a view showing a part of a side close to the bill insert/discharge port 50*b*. At this time, since the upper door 81 is located on the upper surface side, it becomes easy to open the upper door 81, and manipulate the inside of the bill storage box 72. In addition, as described above, the gate roller 43*b* and the upper door 81 are evacuated in conjunction with each other, thereby making easy the insert and taking-out of the bills by the user.

An opening and closing portion 200 for making possible an access to the internal conveyance path 80*b* when the retained bills (jammed bills) are removed away is provided in the downside of the upper storage unit 700*b* (on the front side of the storage box). The opening and closing portion 200 is a thing for carrying out the opening and closing operation with a fulcrum 201 as a center. In a phase of a normal operation, the opening and closing portion 200 is set in the closing state, thereby preventing the access of the internal conveyance path 80*b* to the conveyance guide 202.

Figure 19:
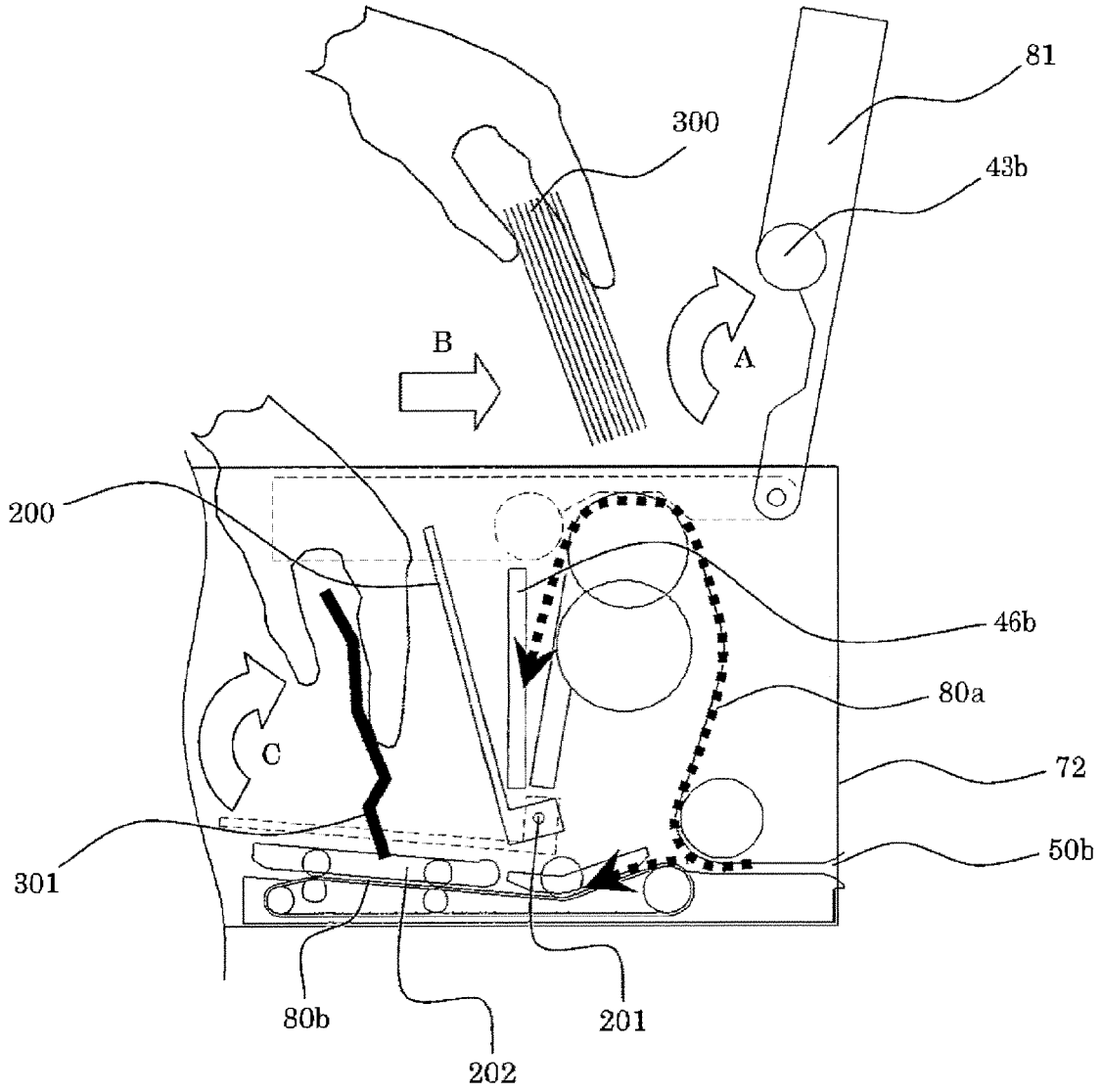
FIG. 19 A view showing a procedure for removing away jammed bills in the bill storage box of the first embodiment.

FIG. 19 is a view showing the procedure for removing away the jammed bills retained on the internal conveyance path. Firstly, a clerk in charge or the like opens the upper door 81 in an outside direction of the bill storage box (in a direction indicated by an arrow A), and takes out the bills 300 accumulated within the upper storage unit 700*b* (hereinafter, the accumulated bills) to the outside of the storage box. When the accumulated bills 300 have been taken out, the push plate 46*b* is moved in the direction (a direction indicated by an arrow B) of the feeding/accumulation mechanical unit by a force of ta spring or the like (not shown), so that a space is ensured in which the clerk in charge or the like manipulates the opening and closing portion 200. After that, the clerk in charge or the like opens the opening and closing portion 200 in a direction indicated by an arrow C of the feeding/accumulation mechanical unit, and removes away the jammed bills 301 from the conveyance guide 202.

In the series of procedure described above, the upper door 81, and the opening, and closing portion 200 are common to each other in that they are opened from the front surface side toward the back surface side (from the upside to the downside of the figure) of the storage box (refer to the arrows A, C of FIG. 19). For this reason, when the accumulated bills 300 and the jammed bills 301 are removed away, a work for changing a direction of the bill storage box 72 becomes unnecessary.

Embodiment 2

Next, a description will be given with respect to a second embodiment of the present invention with reference to the drawing, it is noted that the structure of the bill handling device 1, and the procedure for removing away the jammed bills are the same as those in the first embodiment. For this reason, only the structure of the bill storage box different from that of the first embodiment will be described.

Figure 20:
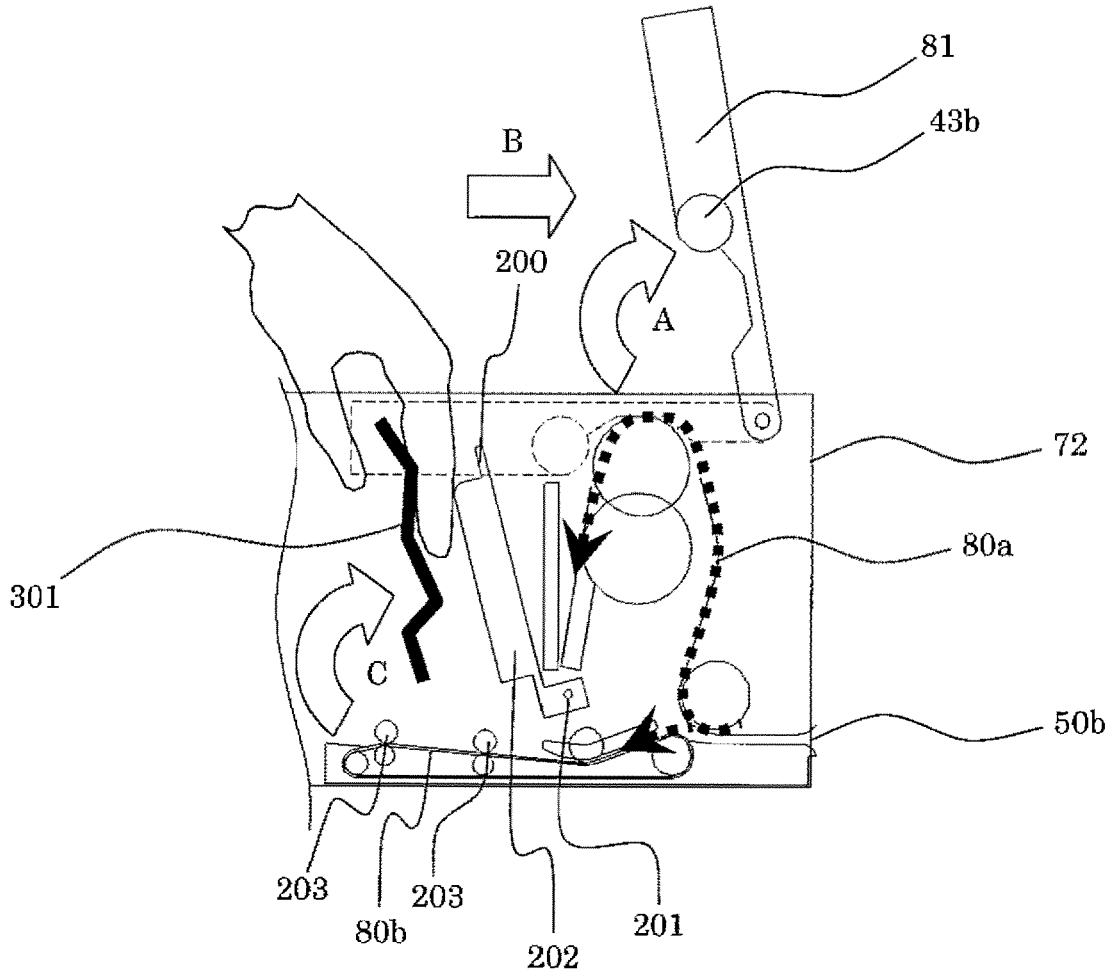
FIG. 20 A side view showing a bill storage box of a second embodiment.

FIG. 20 is a side view in which the back surface of the storage box is made the upper surface (an upside of the figure), and the front surface of the storage box is made the bottom surface (a downside of the figure), and is a view showing a part of a side close to the bill insert/discharge port 50*b*. In this embodiment, the opening and closing portion 200 provided on the downside (on the front surface side of the storage box) of the upper storage unit 700*b*, and the conveyance guide 202 for stably conveying the bills conveyed to the internal conveyance path 80*b* are formed through integral molding. At this time, when the opening and closing portion 200 is opened in the direction of the feeding/accumulation mechanism unit, the conveyance guide 202 is also moved together with the opening and closing portion 200 in the direction of the feeding/accumulation mechanism unit. For this reason, the work for changing the direction of the bill storage box 72 becomes unnecessary, and it is made easy to remove away the jammed bills 301 from the internal conveyance path 80*b*.

The opening and closing portion 200 is the thing for carrying out the opening and closing operation with the fulcrum 201 as the center similarly to the first embodiment. However, since the opening and closing portion 200 has the function as the conveyance guide, when the hills are conveyed to the internal conveyance path 80*b*, the position of the opening and closing portion 200 is desirably fixed. In this case, the opening and closing portion 200 cannot be moved with a conveyance force by which the bills are conveyed to the internal conveyance path 80*b*. However, a dynamic friction coefficient between the fulcrum 201 and the rotating working is adjusted in such a way that the clerk in charge or the like becomes easy to open the opening and closing portion 200 by a hand working.

Figure 21:
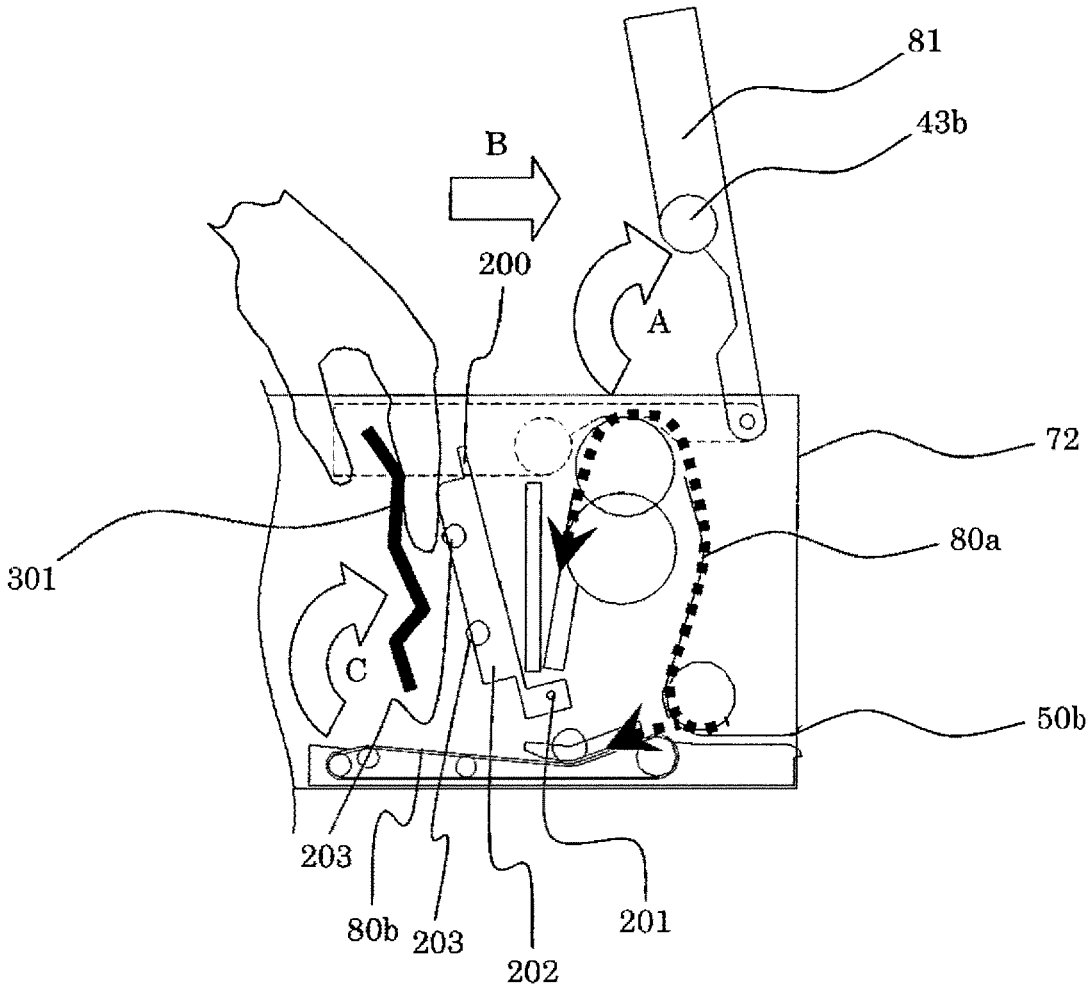
FIG. 21 A view showing another embodiment of the second embodiment.

It is noted that as shown in FIG. 21, the rotating shaft of the pinch roller 203 for pinching and conveying the bills conveyed to the internal conveyance path 80*b* may be provided on the side of the conveyance guide 202. In this case, when the opening and closing portion 200 is opened in the direction of the feeding/accumulation mechanical unit, the conveyance guide 202 and the pinch roller 203 are also moved together with each other in the direction of the feeding/accumulation mechanical unit. For this reason, as compared with the case, as shown in FIG. 20, where the pinch roller 203 is held on the side of the internal conveyance path 80*b*, it becomes easier to remove away the jammed bills 301 from the internal conveyance path 80*b*.

Embodiment 3

Next, a description will be given with respect to a third embodiment of the present invention with reference to the drawing. It is noted that the structure of the bill handling device 1 is the same as that in the first embodiment. For this reason, the structure of the bill storage box, and the procedure for removing away the jammed bills which are different from those in the first embodiment will be described.

Figure 22:
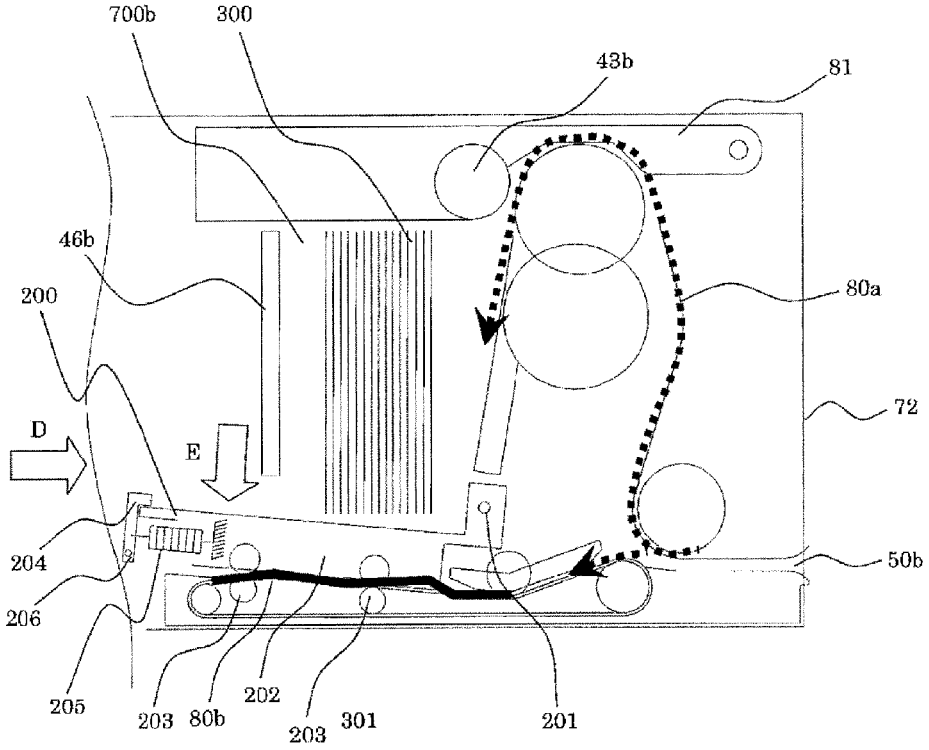
FIG. 22 A side view showing a bill storage box of a third embodiment.

FIG. 22 is a side view in which the back surface of the storage box is made the upper surface (an upside of the figure), and the front surface of the storage box is made the bottom surface (a downside of the figure), and is a view showing a part of a side close to the bill insert/discharge port 50*b*. In this embodiment, although this embodiment is common to the second embodiment in that the opening and closing portion 200, and the conveyance guide 202 are formed through the integral molding, this embodiment is different from the second embodiment in that a lock mechanism for locking the position of the opening and closing portion 200 is specially provided. Providing the lock mechanism results in that the position of the opening and closing portion 200 can be reliably locked, and the bills on the internal conveyance path 80*b* can be conveyed in a state in which a pinching force by the pinch roller 203 is stable.

The lock mechanism is composed of a lock lever 204 and an elastic body 205 such as a spring. The lock lever 204 is moved with a fulcrum 206 as a rotation center. Thus, the lock mechanism is biased in a direction (in a direction indicated by an arrow D) in which the feeding/accumulation mechanism unit is provided by an elastic force of the elastic body 205. For this reason, the opening and closing portion 200 is held in a state in which it is closed in a direction (in a direction indicated by an arrow E) of the front surface of the bill storage box 72.

It is noted that with regard to the position of the rotating shaft of the pinch roller 203, it is possible to both provide the pinch roller 203 in a position different from that of the conveyance guide 202 in order to fix the pinch roller 203, and provide the pinch roller 203 on the conveyance guide 202 side in order to make it easy to remove away the jammed bills 301.

Hereinafter, a description will be given with respect to the procedure for removing away the jammed bills from the bill storage box. Firstly, the clerk in charge or the like opens the upper door 81 in the direction of the outside of the bill storage box, and takes out the accumulated bills 300 to the outside of the storage box. When the accumulated bills 300 have been removed away, the push plate 46*b* is moved in the direction (in the direction indicated by the arrow B) of the feed/accumulation mechanical unit by the force of the spring or the like (not shown), so that the space is ensured in which the clerk in charge or the like manipulates the opening and closing portion 200. After that, the clerk in charge or the like moves the lock lever 204 in a direction (in a direction opposite to the direction indicated by the arrow D) opposite to the direction in which the feeding/accumulating mechanical unit is provided, thereby releasing the lock of the opening and closing portion 200. After the release of the lock, the opening and closing portion 200 is opened in the direction of the feeding/accumulating mechanical unit, thereby removing away the jammed bills 301.

Embodiment 4

Next, a description will be given with respect to a fourth embodiment of the present invention with reference to the drawing. It is noted that the structure of the bill handling device 1, and the procedure for removing away the jammed bills are the same as those in the first embodiment. For this reason, only the structure of the bill storage box different from that in the first embodiment will be described.

Figure 23:
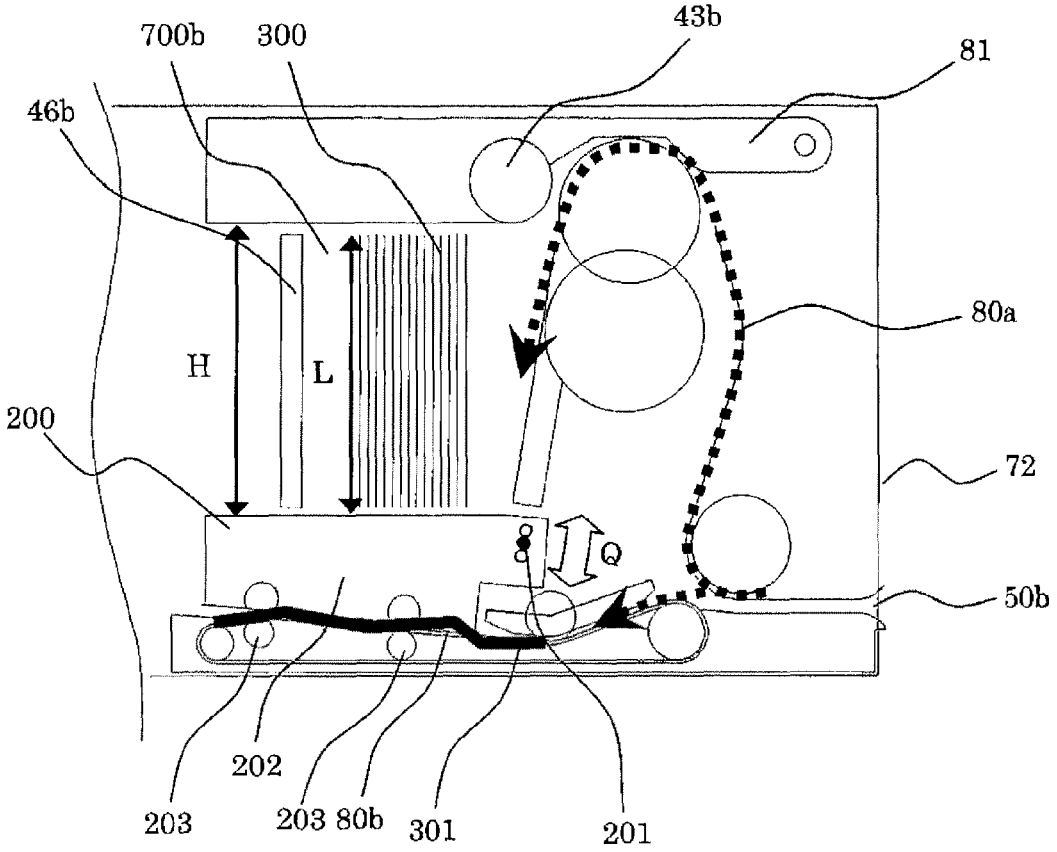
FIG. 23 A side view showing a bill storage box of a fourth embodiment.
Figure 24:
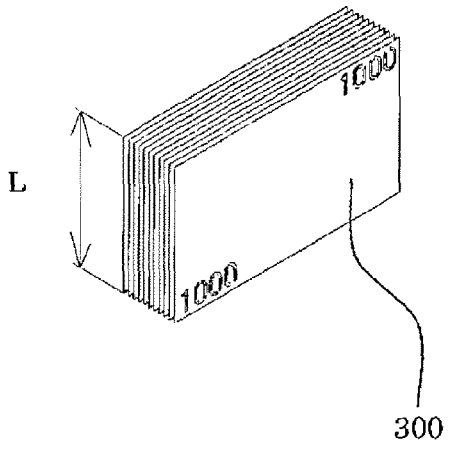
FIG. 24 A view showing a state in which bills are accumulated.

FIG. 23 is a side view in which the back surface of the storage box is made the upper surface (an upside of the figure), and the front surface of the storage box is made the bottom surface (a downside of the figure), and is a view showing a part of a side close to the bill insert/discharge port 50*b*. In this embodiment, the opening and closing portion 200, and the conveyance guide 202 are formed through the integral molding, and a part of the opening and closing portion 200 is given a function as a stopper guide. Here, the stopper guide means a guide for aligning the edges of the accumulated bills so as not to cause the jam when the accumulated bills are conveyed again. Note that, in the case of this embodiment, suppose that only one denomination of bills are accumulated in the upper storage unit 700*b*, and lengths L (refer to FIG. 24) in a short direction of the accumulated bills 300 are approximately the same (for example, L=about 77 mm in the case of a 50-euro bill. In addition, L=about 82 mm in the cases of the 100-euro bill, a 200-euro bill, and a 500-euro bill).

In addition, the position of the stopper guide 210 can be changed so as to correspond to the lengths L in the short direction of the accumulated bills 300. Specifically plural bearings of the stopper guide 210 are provided, whereby the stopper guide is moved in a direction indicated by an arrow Q, and a width H of the upper storage unit 700*b* is changed in accordance with the difference in denomination as described above.

In addition, in the case of this embodiment, when the bills are inserted into the upper storage unit 700 again after the jammed bills 301 have been removed away, the positions in a longitudinal, direction of the bills can be aligned by the stopper guide function of the opening and closing portion 200 so as to become approximately parallel with the front surface of the storage box. For this reason, it becomes possible to enhance the performance of accumulation of the bills accumulated in the upper storage unit 700*b*. It is noted that a part of the opening and closing portion 200 of the first to third embodiments may be given the function as the stopper guide similarly to this embodiment.

Embodiment 5

Next, a description will be given with respect to a fifth embodiment of the present invention with reference to the drawing. It is noted that the structure of the bill handling device 1, and the procedure for removing away the jammed bills are the same as those in the first embodiment. For this reason, only the structure of the bill storage box different from that in the first embodiment will be described.

Figure 25:
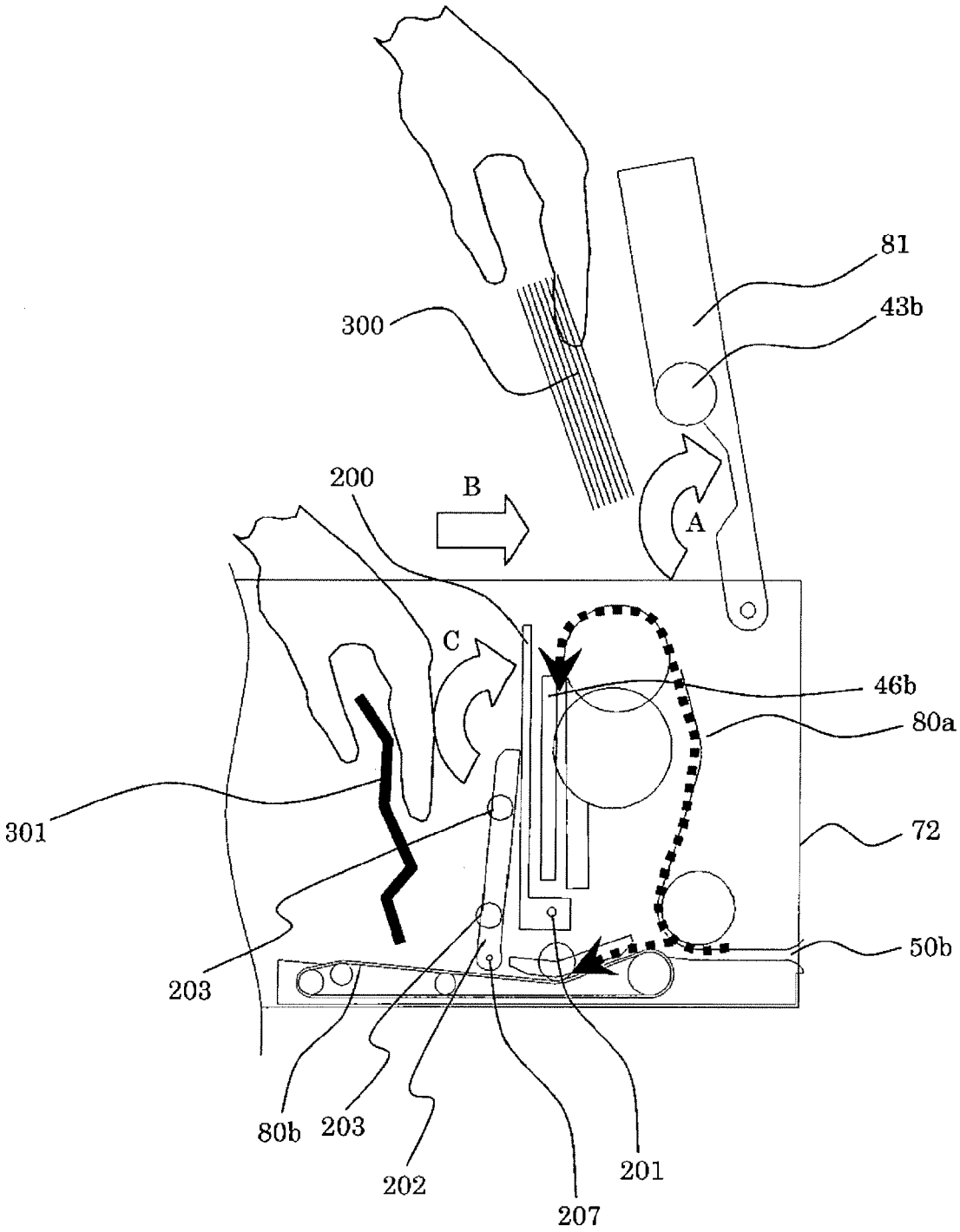
FIG. 25 A side view showing a bill storage box of a fifth embodiment.

FIG. 25 is a side view in which the back surface of the storage box is made the upper surface (an upside of the figure), and the front surface of the storage box is made the bottom surface (a downside of the figure), and is a view showing a part of a side close to the bill insert/discharge port 50*b*. In this embodiment, similarly to the first embodiment, this embodiment is common to the first embodiment in that the opening and closing portion 200, and the conveyance guide 202 have the different structures, respectively. However, this embodiment is different from the first embodiment in that the fulcrum 201 of the opening and closing portion 200, and the fulcrum 207 of the conveyance guide 202 are provided differently from each other.

This embodiment is common to the second embodiment in that both of the opening and closing portion 200, and the conveyance guide 202 are opened, thereby removing way the jammed bills 301. However, unlike the second embodiment, the opening and closing portion 200, and the conveyance guide 202 have the different structures, respectively, and the respective fulcrums are made different from each other. As a result, as compared with the second embodiment, when the jammed bill are attempted to be removed away, the conveyance guide 202 can be largely opened with the opening and closing portion 200 not posing an impediment (a concrete opening degree of the conveyance guide is about 90 degrees), and the jammed bills 301 can be readily removed away. It is noted that when the opening and closing portion 200 is given the function as the stopper guide as math the fourth embodiment, this embodiment may be applied thereto.

The procedure for removing away the jammed bills from the bill storage box 72 is as follows.

Firstly, the clerk in charge or the like opens the upper door 81 in the direction (in the direction indicated by the arrow A) of the outside of the bill storage box, and takes out the accumulated bills 300 to the outside of the storage box. When the accumulated bills 300 have been removed away, the push plate 46*b* is moved in the direction (in the direction indicated by the arrow B) of the feeding/accumulation mechanical unit by the force of the spring or the like (not shown), so that the space is ensured in which the clerk in charge or the like manipulates the opening and closing portion 200, and the conveyance guide 202. After that, the clerk in charge or the like opens the opening and closing 200, and the conveyance guide 202 in this order in the direction (in the direction indicated by the arrow C) in which the feeding/accumulation mechanical unit is provided, and removes away the jammed bills 301.

Note that, when the bills are conveyed to the internal conveyance path 80*b*, the positions of the opening and closing portion 200, and the conveyance guide 202 are desirably fixed. However, the dynamic friction coefficient between, the individual fulcrums 201 and 207, and the rotating shaft is adjusted in such a way that the opening and closing portion 200, and the conveyance guide 202 cannot be moved with the conveyance force by which the bills are conveyed to the internal conveyance path 80*b*, but the clerk in charge or the like becomes easy to open the opening and closing portion 200, and the conveyance guide 202 by the hand working, thereby making it possible to fix the positions.

Embodiment 6

Next, a description will be given with respect to a sixth embodiment of the present invention with reference to the drawing. It is noted that the structure of the bill handling device 1, and the procedure for removing away the jammed bills are the same as those in the first embodiment. For this reason, only the structure of the bill storage box different from that in the first embodiment will be described.

Figure 26:
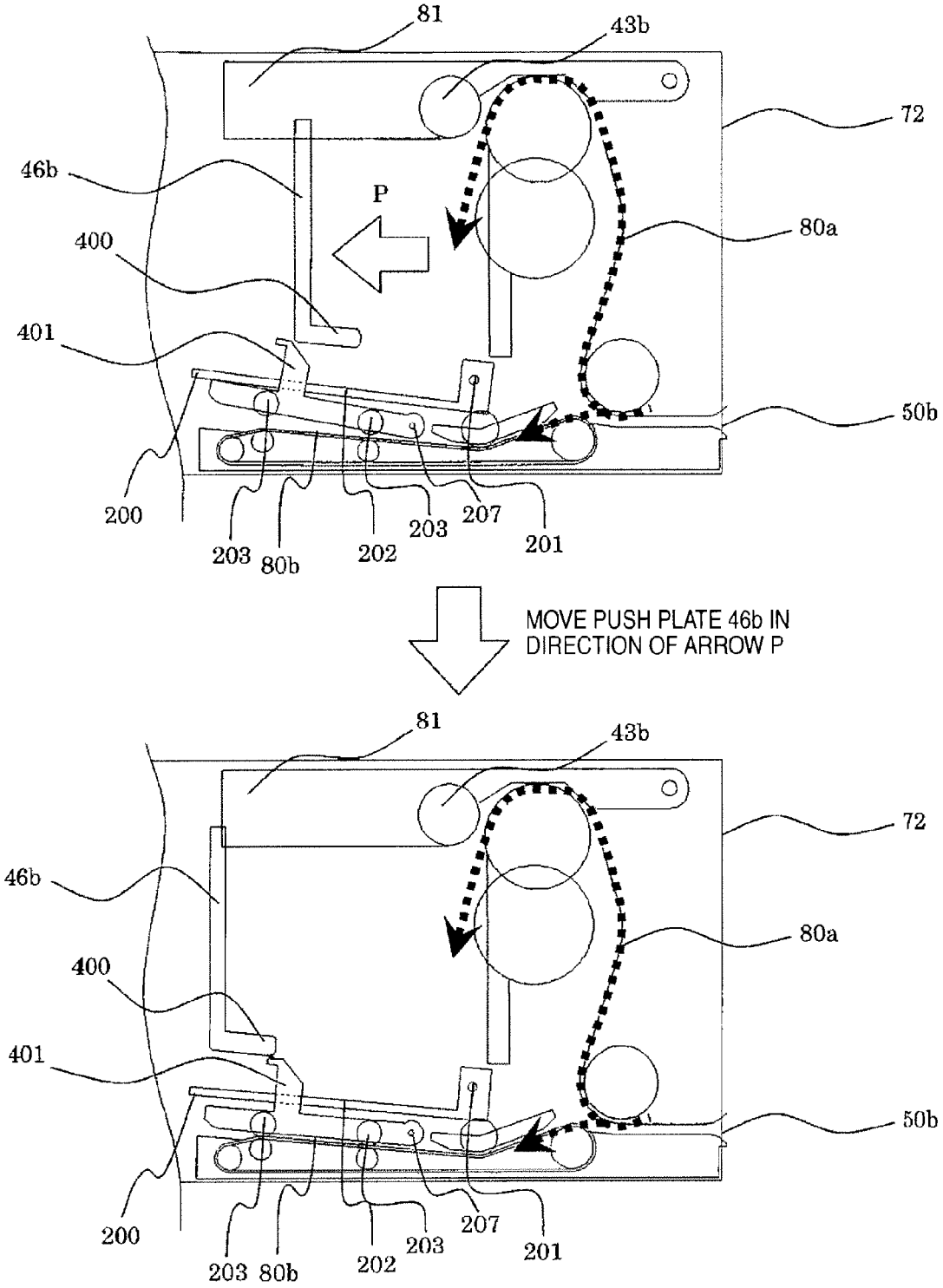
FIG. 26 A side view showing a bill storage box of a sixth embodiment.

FIG. 26 is a side view in which the back surface of the storage box is made the upper surface (an upside of the figure), and the front surface of the storage box is made the bottom surface (a downside of the figure), and is a view showing a part of a side close to the bill insert/discharge port 50*b*. Although in this embodiment, a description will be given with respect to the case where the opening and closing portion 200, and the conveyance guide 202 have the different structures, respectively, and the respective fulcrums are made different from each other similarly to the fifth embodiment, this embodiment can also be applied to other embodiments.

As described in the fifth embodiment, the positions of the opening and closing portion 200, and the conveyance guide 202 need be fixed. In particular, with respect to the conveyance guide 202 by which the bills are actually conveyed, desirably, the dynamic friction coefficient between the fulcrum 207 and the rotating shaft is adjusted, and in addition thereto, a mechanism for fixing the position of the conveyance guide 202 is provided, thereby reliably fixing the position of the conveyance guide 202.

In this embodiment, concave portions 400 and 401 are provided in the push plate 46*b* and the conveyance guide 202, respectively. For example, when the bills one taken out are loaded again or in the phase of the actual operation, the push plate 46*b* is moved in a direction (in a direction indicated by an arrow P) opposite to the direction in which the feeding/accumulation mechanical unit is provided. At this time, the concave portions 400 and 401 are moved so as to contact each other, which results in that the conveyance guide 202 is pressed against the front surface side of the storage box. For this reason, the pinching force for the bills by the pinch roller 203 is not weakened, and thus it becomes possible to reliably convey the bills on the internal conveyance unit 80*b*.

As described above, according to the claimed invention, when the jammed bills retained on the internal conveyance path of the bill storage box having the plural storage units are attempted to be removed away, the direction in which the upper door of the bill storage box is opened, and the direction in which the opening and closing portion of the internal conveyance path is opened are made the same direction. For this reason, it is possible to provide the bill storage box in which the property for removing away the jammed bills is enhanced.

In addition, the opening and closing portion, and the conveyance guide are structured integrally with each other, and the structure is adopted in which the conveyance guide and the pinch roller are moved together with each other. As a result, it is possible to provide the bill storage box in which the access to the jammed bills is made easy, and the work for removing away the jammed bills is improved. In addition, the opening and closing portion, and the conveyance guide are structured integrally with, each other, which results in that it is possible to provide the bill storage box in which the work for removing away the jammed bills is improved, and the accumulation performance is enhanced.

Moreover, the fulcrum 201 of the opening and closing portion 200, and the fulcrum 211 of the stopper guide 210 are provided differently from each other, and the opening degree of the opening and closing portion 200 is made large, which results in that it is possible to provide the bill storage box in which the property for removing away the jammed bills are extremely enhanced.

REFERENCE SIGNS LIST

1 . . . bill handling device, 2 . . . control unit of bill handling device, 10*a* to 10*f* . . . conveyance path, 20 . . . bill insert/discharge port, 30 . . . bill discriminating unit, 35 . . . temporarily storage box, 41*a* to 41*f* . . . feed roller, 42*a* to 42*f* . . . pickup roller, 43*a* to 43*f* . . . gate roller, 44*a* to 44*f* . . . brush roller, 45*a* to 45*f* . . . stack guide, 46*a* to 46*f* . . . push plate, 47*a* to 47*f* . . . pinch roller, 48*b* to 48*c* . . . shall of feed roller, 49*b* . . . shaft of gate roller, 50*a* to 50*c* . . . insert/discharge port, 51*a* to 51*c* . . . roller, 52*a* to 52*c* . . . sorting gate, 61*a* to 61*c* . . . DC motor, 62*a* to 62*b*, 63*a* to 63*b*, 64*a* to 64*b*, 66, 67 . . . driving transmitting gear, 65*a* to 65*b* . . . timing belt, 65*c* . . . conveyance belt, 68 . . . connector, 70 . . . loading box, 71 . . . bill storage box including single storage unit in inside thereof, 72 . . . bill storage box including two single storage units in inside thereof 80*a* to 80*d* . . . internal conveyance path, 81 . . . upper door, 82 . . . lower door, 83 . . . rotating shaft of upper door, 84 . . . rotating shaft of lower door, 90 . . . conveyance guide to upper storage unit, 91 . . . shaft position plate, 200 . . . opening and closing portion, 201 . . . fulcrum of opening and closing portion, 202 . . . conveyance guide, 203 . . . pinch roller, 204 . . . lock lever, 205 . . . elastic body, 206 . . . fulcrum of lock lever, 207 . . . fulcrum of conveyance guide, 300 . . . accumulated bills, 301 . . . jammed bills, 400 . . . convex portion of push plate, 401 . . . convex portion of conveyance guide

The invention claimed is:

1. A bill storage box having plural bill storage units inside thereof, comprising:

a bill insert/discharge port provided in an upper surface of the bill storage box for inputting and discharging bills to and from an outside; a conveyance path for bidirectionally conveying the bills between the bill insert/discharge port and the bill storage units, the conveyance path including at least a first internal conveyance path for conveying the bills approximately in a vertical direction;

at least a first bill storage unit and a second bill storage unit being stacked and arranged in this order from a side of the bill insert/discharge port;

a door for loading and taking out the bills provided within the bill storage units, the door being provided on a side opposite to a side surface in which the bill insert/discharge port is provided; and an opening and closing portion for allowing an access to the bills retained on said internal conveyance path between the first bill storage unit and the first internal conveyance path, wherein an opening and closing direction of the door for loading and taking out the bills within the first bill storage unit and an opening and closing direction of the opening and closing portion are made approximately in the same direction, and wherein the opening and closing portion may be operated without changing an orientation of the first bill storage unit when the door for loading and taking out the bills is open.

2. The bill storage box according to claim 1, wherein:

the bill storage box has a conveyance guide for the bills conveyed to the first internal conveyance path, and the opening and closing portion, and the conveyance guide are structured integrally with each other.

3. The bill storage box according to claim 2, wherein:

the bill storage box has a pinch roller for conveying the bills conveyed to the first internal conveyance path, and a rotating shaft of the pinch roller is provided in the conveyance guide.

4. The bill storage box according to claim 1, wherein:

a lock mechanism for locking a position of the opening and closing portion is provided.

5. The bill storage box according to claim 1, wherein:

the bill storage box has a conveyance guide for the bills conveyed to the first internal conveyance path, and a fulcrum of the opening and closing portion, and a fulcrum of the conveyance guide are provided differently from each other.

6. The bill storage box according to claim 5, wherein:

an opening degree of the conveyance guide is about 90 degrees.

7. The bill storage box according to claim 5, wherein:

the bill storage box has a push plate including a convex portion accessible to the conveyance guide, the push plate being provided being provided approximately in a vertical direction of the first bill storage unit, and the push plate is moved approximately in the vertical direction, thereby causing the conveyance guide and the push plate to contact each other.

8. The bill storage box according to claim 1, wherein:

the bill storage box has a gate roller provided in the first bill storage unit, the gate roller rotating when the bills are accumulated in the bill storage unit, and not rotating when the bills are fed from the bill storage unit, and the gate roller is moved integrally with the door.

9. The bill storage box according to claim 1, wherein:

the bill storage box has a second internal conveyance path for conveying the bills approximately in a horizontal direction, and both sides of each of the bills conveyed to the second internal conveyance path are reversed, and the bills are stored in the bill storage unit disposed closest to the bill insert/discharge port.

10. The bill storage box according to claim 1, wherein:

the first bill storage unit is disposed so as to be eccentrically located on a predetermined side surface side, and the second storage unit is disposed so as to be eccentrically located on the other side surface side at a side opposite to the predetermined side surface.

11. A bill handling device, comprising:

a bill insert/discharge port for allowing insertion and taking-out of bills by a user;

a bill discriminating unit for discriminating between inserted bills and bills to be taken out;

a conveyance path for conveying the bills; and an installing unit in which the bill storage box according to claim 1 is installable, wherein the installing unit is structured in such a way that a bill storage box including only one bill storage unit having a feeding/accumulation mechanical unit for carrying out a feeding operation and an accumulating operation for the bills, and the bill storage box according to claim 1 is arbitrarily selected so as to be installable.

* * * * *